US010590707B2

(12) United States Patent
Russell et al.

(10) Patent No.: US 10,590,707 B2
(45) Date of Patent: Mar. 17, 2020

(54) AUGMENTED DRILLING SYSTEM

(71) Applicant: HYPERSCIENCES, INC., Spokane, WA (US)

(72) Inventors: Mark C. Russell, Spokane, WA (US); Timothy J. Elder, Spokane, WA (US); Hossam Elbadawy, Katy, TX (US); Jeffrey B. Lasater, Houston, TX (US); John Benjamin Hinkey, Seattle, WA (US)

(73) Assignee: HYPERSCIENCES, INC., Spokane, WA (US)

( * ) Notice: Subject to any disclaimer, the term of this patent is extended or adjusted under 35 U.S.C. 154(b) by 209 days.

(21) Appl. No.: 15/698,549

(22) Filed: Sep. 7, 2017

(65) Prior Publication Data

US 2018/0073301 A1 Mar. 15, 2018

Related U.S. Application Data

(60) Provisional application No. 62/393,631, filed on Sep. 12, 2016.

(51) Int. Cl.
*E21B 7/00* (2006.01)
*E21B 7/16* (2006.01)
(Continued)

(52) U.S. Cl.
CPC ..... *E21B 7/007* (2013.01); *E21B 7/067* (2013.01); *E21B 7/16* (2013.01); *E21B 44/00* (2013.01);
(Continued)

(58) Field of Classification Search
CPC . E21B 4/02; E21B 7/007; E21B 7/067; E21B 7/16; E21B 44/00; E21B 47/00; E21B 47/06; E21B 47/065
See application file for complete search history.

(56) References Cited

U.S. PATENT DOCUMENTS 2,544,573 A 3/1951 Vincent
2,621,732 A 12/1952 Ahlgren
(Continued)

FOREIGN PATENT DOCUMENTS

CN 101017076 8/2007
CN 101099024 1/2008
(Continued)

OTHER PUBLICATIONS

Thomas, Shane, "Patent Cooperation Treaty International Search Report and Written Opinion dated Feb. 2, 2017", Patent Cooperation Treaty Application No. PCT/US16/61660, Patent Cooperation Treaty, dated Feb. 2, 2017.
(Continued)

*Primary Examiner* — David Carroll
(74) *Attorney, Agent, or Firm* — Lindauer Law, PLLC

(57) ABSTRACT

A drill string comprises a mechanical drill bit and a ram accelerator with a launch tube proximate to the mechanical drill bit. A projectile accelerated by the ram accelerator exits the mechanical drill bit through an orifice and impacts a geologic formation. The impact weakens a portion of the formation, enabling the drill bit to penetrate the weakened portion more easily. An endcap may be used to prevent outside material from entering the ram accelerator. The projectile may pass through or otherwise displace the endcap during operation. The launch tube may be positioned at an angle relative to the drill bit such that projectiles impact and weaken the formation on a particular side. Contact between the drill bit and the formation may direct the drill bit toward the weakened side, enabling the ram accelerator to be used to steer the drill bit.

20 Claims, 13 Drawing Sheets

(51) Int. Cl.

| | |
|---|---|
| ***E21B 7/06*** | (2006.01) |
| ***E21B 44/00*** | (2006.01) |
| ***E21B 47/00*** | (2012.01) |
| ***E21B 47/06*** | (2012.01) |
| *E21B 4/02* | (2006.01) |

(52) U.S. Cl.

CPC ..... *E21B 47/00* (2013.01); *E21B 47/06* (2013.01); *E21B 47/065* (2013.01); *E21B 4/02* (2013.01)

(56) References Cited

U.S. PATENT DOCUMENTS

| | | | | |
|---|---|---|---|---|
| 2,913,959 | A | 11/1959 | Mohaupt | |
| 3,075,463 | A | 1/1963 | Eilers et al. | |
| 3,185,224 | A | 5/1965 | Robinson, Jr. | |
| 3,190,372 | A | 6/1965 | Johnson | |
| 3,244,232 | A | 4/1966 | Myers | |
| 3,253,511 | A | 5/1966 | Zwicky | |
| 3,434,380 | A * | 3/1969 | Dardick | F41A 9/27 42/39.5 |
| 3,441,095 | A | 4/1969 | Youmans | |
| 3,633,686 | A | 1/1972 | Bennett | |
| 3,695,715 | A | 10/1972 | Godfrey | |
| 3,855,931 | A * | 12/1974 | Dardick | F41A 9/27 102/436 |
| 3,863,723 | A | 2/1975 | Godfrey | |
| 3,867,867 | A | 2/1975 | Duff | |
| 4,004,642 | A * | 1/1977 | Dardick | E21B 4/00 175/4.5 |
| 4,030,557 | A | 6/1977 | Alvis et al. | |
| 4,063,486 | A | 12/1977 | Ashley | |
| 4,123,975 | A | 11/1978 | Mohaupt | |
| 4,158,388 | A | 6/1979 | Owen et al. | |
| 4,467,878 | A | 8/1984 | Ibsen | |
| 4,582,147 | A * | 4/1986 | Dardick | E21B 7/007 175/1 |
| 4,638,712 | A | 1/1987 | Chawla et al. | |
| 4,679,637 | A | 7/1987 | Cherrington et al. | |
| 4,722,261 | A | 2/1988 | Titus | |
| 4,791,850 | A | 12/1988 | Minovitch | |
| 4,907,488 | A | 3/1990 | Seberger | |
| 4,932,306 | A | 6/1990 | Rom | |
| 4,982,647 | A | 1/1991 | Hertzberg et al. | |
| 5,063,826 | A | 11/1991 | Bulman | |
| 5,097,743 | A | 3/1992 | Hertzberg et al. | |
| 5,098,163 | A | 3/1992 | Young, III | |
| 5,146,992 | A | 9/1992 | Baugh | |
| 5,233,903 | A | 8/1993 | Saphier et al. | |
| 5,421,237 | A | 6/1995 | Naumann | |
| 5,487,405 | A | 1/1996 | Skoglund | |
| 5,574,244 | A | 11/1996 | Powell et al. | |
| 5,578,783 | A | 11/1996 | Brandeis | |
| 5,768,940 | A | 6/1998 | Kawaguchi et al. | |
| 5,833,003 | A * | 11/1998 | Longbottom | E21B 7/007 166/298 |
| 5,996,709 | A | 12/1999 | Norris | |
| 6,000,479 | A | 12/1999 | Ambs | |
| 6,035,784 | A | 3/2000 | Watson | |
| 6,457,417 | B1 | 10/2002 | Beal | |
| 6,467,387 | B1 | 10/2002 | Espinosa et al. | |
| 6,591,731 | B2 | 7/2003 | Goldstein | |
| 6,820,697 | B1 | 11/2004 | Churchill | |
| 7,069,862 | B2 | 7/2006 | Bassett | |
| 7,681,352 | B2 | 3/2010 | Fu et al. | |
| 7,775,148 | B1 | 8/2010 | McDermott | |
| 7,942,481 | B2 | 5/2011 | Leppanen | |
| 8,104,568 | B2 | 1/2012 | Luchini et al. | |
| 8,181,561 | B2 | 5/2012 | Riggs et al. | |
| 8,302,584 | B1 | 11/2012 | Lu | |
| 8,943,970 | B2 | 2/2015 | Greeley et al. | |
| 9,103,618 | B2 | 8/2015 | Daniel et al. | |
| 9,103,624 | B1 | 8/2015 | Kung et al. | |
| 9,169,695 | B1 | 10/2015 | Calvert | |
| 9,540,895 | B2 | 1/2017 | MacKenzie et al. | |
| 10,132,578 | B2 | 11/2018 | Knowlen et al. | |
| 2001/0045288 | A1 | 11/2001 | Allamon et al. | |
| 2005/0034896 | A1 | 2/2005 | Youan | |
| 2007/0044963 | A1 | 3/2007 | MacDougall | |
| 2007/0186761 | A1 | 8/2007 | Perry | |
| 2007/0256826 | A1 | 11/2007 | Ceccarelli et al. | |
| 2008/0205191 | A1 | 8/2008 | Coste et al. | |
| 2009/0322185 | A1 | 12/2009 | Barnard et al. | |
| 2010/0032206 | A1 | 2/2010 | Becker et al. | |
| 2010/0133006 | A1 | 6/2010 | Shakra et al. | |
| 2011/0114388 | A1 | 5/2011 | Lee et al. | |
| 2011/0186377 | A1 | 8/2011 | Kline et al. | |
| 2013/0032337 | A1 | 2/2013 | Rytlewski et al. | |
| 2014/0158356 | A1 | 6/2014 | Andrzejak et al. | |
| 2014/0260930 | A1 | 9/2014 | Russell | |
| 2014/0367604 | A1 * | 12/2014 | Alexander | F42D 1/10 252/62 |
| 2015/0021023 | A1 | 1/2015 | Roberts et al. | |
| 2015/0152700 | A1 | 6/2015 | Lovorn et al. | |
| 2015/0330147 | A1 * | 11/2015 | Russell | F41A 1/02 89/7 |

FOREIGN PATENT DOCUMENTS

| | | | |
|---|---|---|---|
| CN | 102322216 | | 1/2012 |
| CN | 102667047 | | 9/2012 |
| CN | 102822442 | | 12/2012 |
| CN | 202596572 | | 12/2012 |
| CN | 103321572 | A | 9/2013 |
| DE | 2420035 | | 3/1976 |
| EP | 0663582 | A3 | 11/1995 |
| WO | 1999037878 | | 7/1999 |
| WO | 2014149173 | A1 | 9/2014 |
| WO | 2015030730 | | 3/2015 |

OTHER PUBLICATIONS

Becamel, Philippe, "Patent Cooperation Treaty International Preliminary Report on Patentabililty dated Sep. 15, 2015", Patent Cooperation Treaty Application PCT/US2014/012317, Patent Cooperation Treaty, dated Sep. 15, 2015.

Committee on Advanced Drilling, "Drilling and Excavation Technologies for the Future", National Research Council, ISBN: 0-309-57320-3, <Retrieved from: http://www.nap.edu/catalog/2349.html>, 1994, 176 pages.

Copenheaver, Blaine R., "Patent Cooperation Treaty International Search Report and Written Opinion dated Aug. 10, 2015", Patent Cooperation Treaty Application No. PCT/US2015/030320 Patent Cooperation Treaty, dated Aug. 10, 2015.

Fang, et al., "Hypersonic Wave Drag Reduction Performance of Cylinders With Repetitive Laser Energy Depositions", 3rd Int'l Photonics & OptoElectronics Meetings (POEM 2010), Journal of Physics: Conference Series 276 (2011) 012021, [retrieved on Oct. 20, 2015]. <Retrieved from http://iopscience.iop.org/article/10.1088/1742-596/276/1/012021/pdf>, 8 pages.

Gold, et al., "Concrete Penetration by Eroding Projectiles Experiments and Analysis", Journal of Engineering Mechanics, v122, pp. 145-152 <Retrieved from: ascelibrary.org on Feb. 17, 2013>, Feb. 1996.

Gold, et al., "Constitutive Models for Concrete Penetration Analysis", Journal of Engineering Mechanics v122 <Retrieved from ascelibrary.org on Feb. 17, 2013 >, Mar. 1996, pp. 230-238.

Jingna, Xie, "First Office Action dated Jun. 2, 2016", CN Patent Application No. 201480016227.3, The Chinese Intellectual Property Office, dated Jun. 2, 2016.

Kasten, Klaus, "European Search Report dated Jan. 23, 2017", EP Application No. 14770528.9, EP Patent Office, dated Jan. 23, 2017.

Lundquist, Robert G., "Underground Tests of the Ream Method of Rock Fragmentation for High-Speed Tunneling", Rapid Excavation and Tunneling Conference Proceedings, Ch 56, <Retrieved from: http://www.onemine.org/view/?d=689528D8459E7257609C73381053FBF203FD5CC5A9FC7839952A414670F0591638551, Mar. 13, 2013>, Jan. 1974, pp. 825-840.

(56) References Cited

OTHER PUBLICATIONS

Sayre, James G., "Non-Final Office Action dated Aug. 24, 2017", U.S. Appl. No. 14/919,657, The United States Patent and Trademark Office, dated Aug. 24, 2017.
Semick, Joshua T., "Non-final Office Action dated Jul. 18, 2017", U.S. Appl. No. 15/246,414, The United States Patent and Trademark Office, dated Jul. 18, 2017.
Semick, Joshua T., "Notice of Allowance dated May 25, 2016", U.S. Appl. No. 14/708,932, The United States Patent and Trademark Office, dated May 25, 2016.
Weber, Jonathan C., "Final Office Action dated Jun. 15, 2017", U.S. Appl. No. 15/292,011, The United States Patent and Trademark Office, dated Jun. 15, 2017.
Weber, Jonathan C., "Non-final Office Action dated Dec. 20, 2016", U.S. Appl. No. 15/292,011, The United States Patent and Trademark Office, dated Dec. 20, 2016.
Weber, Jonathan C., "Non-Final Office Action dated Jun. 1, 2015", U.S. Appl. No. 13/841,236, The United States Patent and Trademark Office, dated Jun. 1, 2015.
Weber, Jonathan C., "Notice of Allowance dated Jul. 14, 2016", U.S. Appl. No. 13/841,236, The United States Patent and Trademark Office, dated Jul. 14, 2016.
Wittmann-Regis, Agnes, "International Preliminary Report on Patentability dated May 4, 2017", Patent Cooperation Treaty Application No. PCT/US2015/056947, Patent Cooperation Treaty, dated May 4, 2017.
Young, Lee W., "Patent Cooperation Treaty International Search Report and Written Opinion dated Jan. 19, 2017", Patent Cooperation Treaty Application No. PCT/US2016/060129, Patent Cooperation Treaty, dated Jan. 19, 2017.
Young, Lee W., "Patent Cooperation Treaty International Search Report and Written Opinion dated Jan. 8, 2016", Patent Cooperation Treaty Application No. PCT/US2015/056947, Patent Cooperation Treaty, dated Jan. 8, 2016.
Young, Lee W., "Patent Cooperation Treaty International Search Report and Written Opinion dated Jul. 28, 2016", Patent Cooperation Treaty Application No. PCT/US2016/028704, Patent Cooperation Treaty, dated Jul. 28, 2016.
Young, Lee W., "Patent Cooperation Treaty International Search Report and Written Opinion dated May 16, 2014", Patent Cooperation Treaty Application No. PCT/US2014/012317, Patent Cooperation Treaty, dated May 16, 2014.
Hutchins, Cathleen R., "Advisory Action dated Feb. 21, 2019", U.S. Appl. No. 15/340,753, The United States Patent and Trademark Office, dated Feb. 21, 2019.
Portocarrero, Manuel C., "Notice of Allowance dated Feb. 7, 2019", U.S. Appl. No. 15/348,796, The United States Patent and Trademark Office, dated Feb. 7, 2019.
Wittman-Regis, Agnes, "Patent Cooperation Treaty International Preliminary Report on Patentability dated Mar. 12, 2019", Patent Cooperation Treaty Application No. PCT/US2017/050736, Patent Cooperation Treaty, dated Mar. 12, 2019.
Bogdanoff, David W., "New Tube End Closure System for the Ram Accelerator", Journal of Propulsion and Power., vol. 10, No. 4, Jul. 1-Aug. 1994, pp. 518-521.
Gao, Ruizi, "Chinese Office Action dated Sep. 25, 2017", Chinese Application No. 2015800272507, CN State Intellectual Property Office, Sep. 25, 2017, 5 pages.
Hansen, Viggo, "Ram Accelerator Animation", YouTube, Science & Technology, Uploaded on May 2, 2011, 1 page. Retrieved from the Internet: https://www.youtube.com/watch?v=iFQfOKVi98I.
Hutchins, Cathleen R., "Non-Final Office Action dated Apr. 12, 2018", U.S. Appl. No. 15/340,753, The United States Patent and Trademark Office, dated Apr. 12, 2018.
Portocarrero, Manuel C., "Non-Final Office Action dated Apr. 11, 2018", U.S. Appl. No. 15/348,796, The United States Patent and Trademark Office, dated Apr. 11, 2018.
Runyan, Ronald R., "Final Office Action dated Jan. 28, 2019", U.S. Appl. No. 15/135,452, The United States Patent and Trademark Office, dated Jan. 28, 2019.
Runyan, Ronald R., "Non-Final Office Action dated Apr. 12, 2018", U.S. Appl. No. 15/135,452, The United States Patent and Trademark Office, dated Apr. 12, 2018.
Van Berlo, Andre, "European Search Report dated Sep. 7, 2017", European Patent Application No. 15791990.3, European Patent Office, dated Sep. 7, 2017.
Weber, Jonathan C., "Non-Final Office Action dated Dec. 28, 2017", U.S. Appl. No. 15/292,011, The United States Patent and Trademark Office, dated Dec. 28, 2017.
Weber, Jonathan C., "Final Office Action dated May 30, 2018", U.S. Appl. No. 15/292,011, The United States Patent and Trademark Office, dated May 30, 2018.
Weber, Jonathan C., "Notice of Allowance dated Sep. 25, 2018", U.S. Appl. No. 15/292,011, The United States Patent and Trademark Office, dated Sep. 25, 2018.
Wittmann-Regis, Agnes, "PCT International Preliminary Report on Patentability dated May 24, 2018", Patent Cooperation Treaty Application No. PCT/US16/60129, Patent Cooperation Treaty, dated May 24, 2018.
Young, Lee W., "International Search Report and Written Opinion dated Nov. 29, 2017", Patent Cooperation Treaty Application No. PCT/US17/50736, Patent Cooperation Treaty, dated Nov. 29, 2017.
Jingna, Xie, "CN Office Action dated Jan. 25, 2017", CN Patent Application No. 2014800162273, The Chinese Patent Office, dated Jan. 25, 2017.
Runyan, Ronald R., "Final Office Action dated Oct. 1, 2019", U.S. Appl. No. 15/135,452, The United States Patent and Trademark Office, dated Oct. 1, 2019.

* cited by examiner

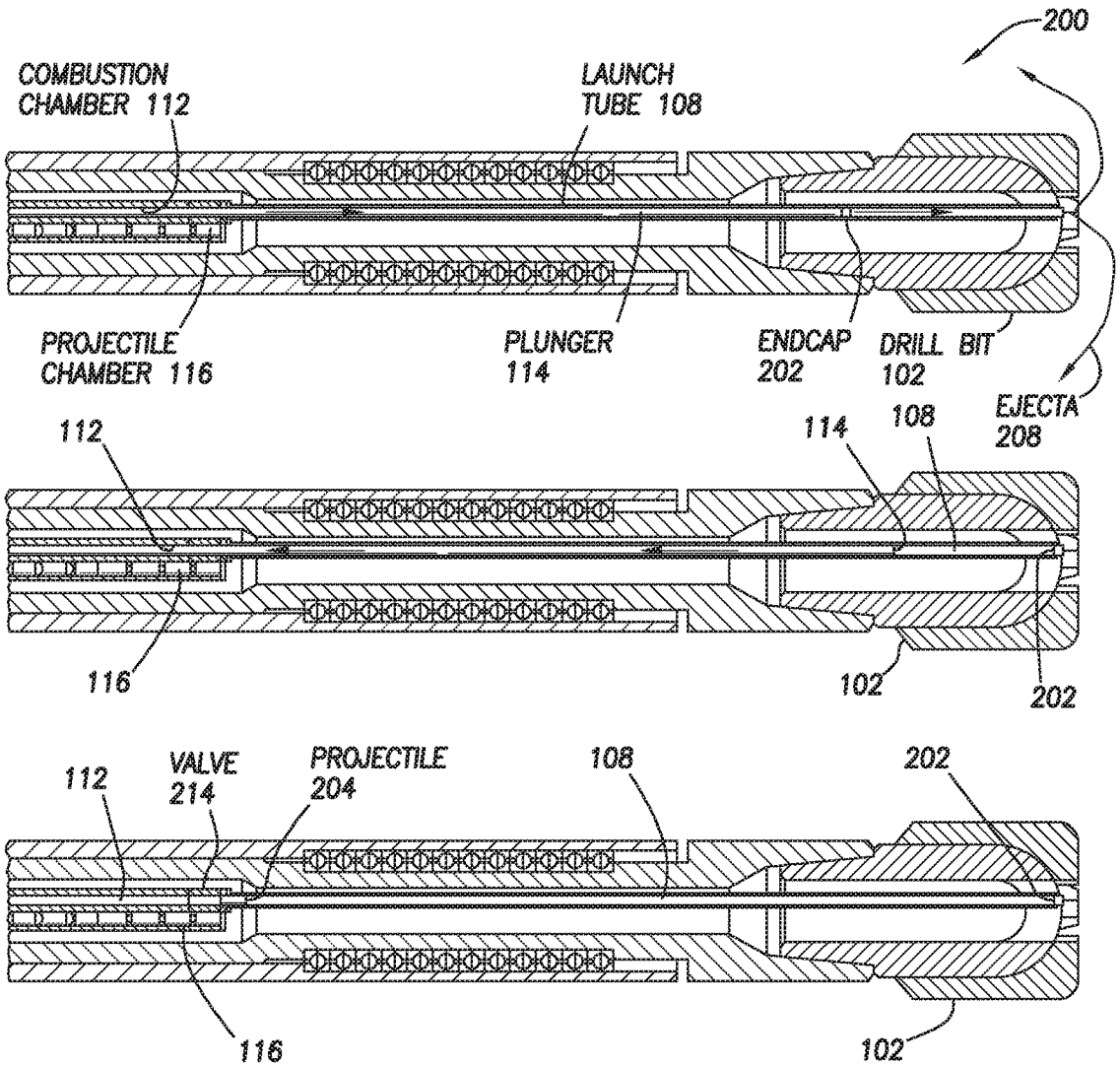
FIG.2
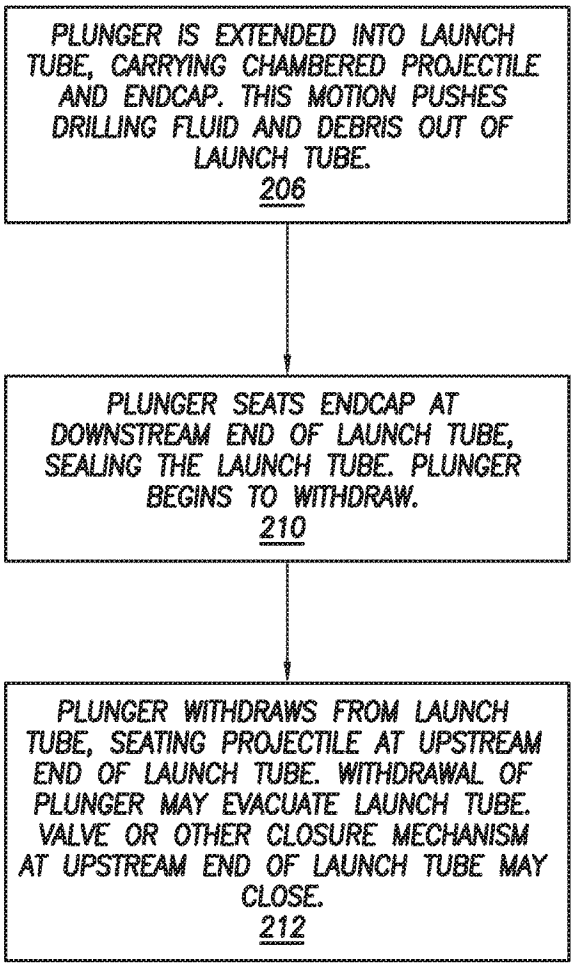

AUGMENTED DRILLING SYSTEM

PRIORITY

The present application claims priority to U.S. Provisional Application 62/393,631 filed on Sep. 12, 2016 entitled "Augmented Drilling System Using Ram Accelerator Assembly" which is hereby incorporated by reference in its entirety.

INCORPORATION BY REFERENCE

The following are incorporated by reference for all that they contain:

"Ram Accelerator System" filed on Mar. 15, 2013, application Ser. No. 13/841,236.

"Ram Accelerator System with Endcap" filed on May 13, 2014, Application No. 61/992,830.

"Ram Accelerator System with Endcap" filed on May 11, 2015, application Ser. No. 14/708,932.

"Ram Accelerator System with Endcap" filed on Aug. 24, 2016, application Ser. No. 15/246,414.

"Ram Accelerator System with Rail Tube" filed on Oct. 23, 2014, Application No. 62/067,923.

"Ram Accelerator System with Rail Tube" filed on Oct. 21, 2015, application Ser. No. 14/919,657.

"Ram Accelerator System with Baffles" filed on Apr. 21, 2015, Application No. 62/150,836.

"Ram Accelerator System with Baffles" filed on Apr. 21, 2016, application Ser. No. 15/135,452.

"Pressurized Ram Accelerator System" filed on Nov. 10, 2015, Application No. 62/253,228.

"System For Generating A Hole Using Projectiles" filed on Nov. 10, 2016, application Ser. No. 15/348,796.

BACKGROUND

Traditional drilling and excavation methods utilize drills to form holes in one or more layers of material to be penetrated. Excavation, quarrying, and tunnel boring may also use explosives placed in the holes and detonated in order to break apart at least a portion of the material. The use of explosives results in additional safety and regulatory burdens which increase operational cost. Typically, these methods cycle from drill to blast to removal of material. Progress may be relatively slow ranging from minutes to hours to days per linear foot, depending on the cross-sectional area of the hole and the methods used to remove the material to form a desired excavation.

BRIEF DESCRIPTION OF DRAWINGS

Certain implementations and embodiments will now be described more fully below with reference to the accompanying figures, in which various aspects are shown. However, various aspects may be implemented in many different forms and should not be construed as limited to the implementations set forth herein. The figures are not necessarily to scale, and the relative proportions of the indicated objects may have been modified for ease of illustration and not by way of limitation. Like reference numbers refer to like elements throughout.

FIG. 2 depicts a method for placing an endcap and a projectile within the launch tube of a ram accelerator assembly, according to one implementation.

DETAILED DESCRIPTION

Figure 1:
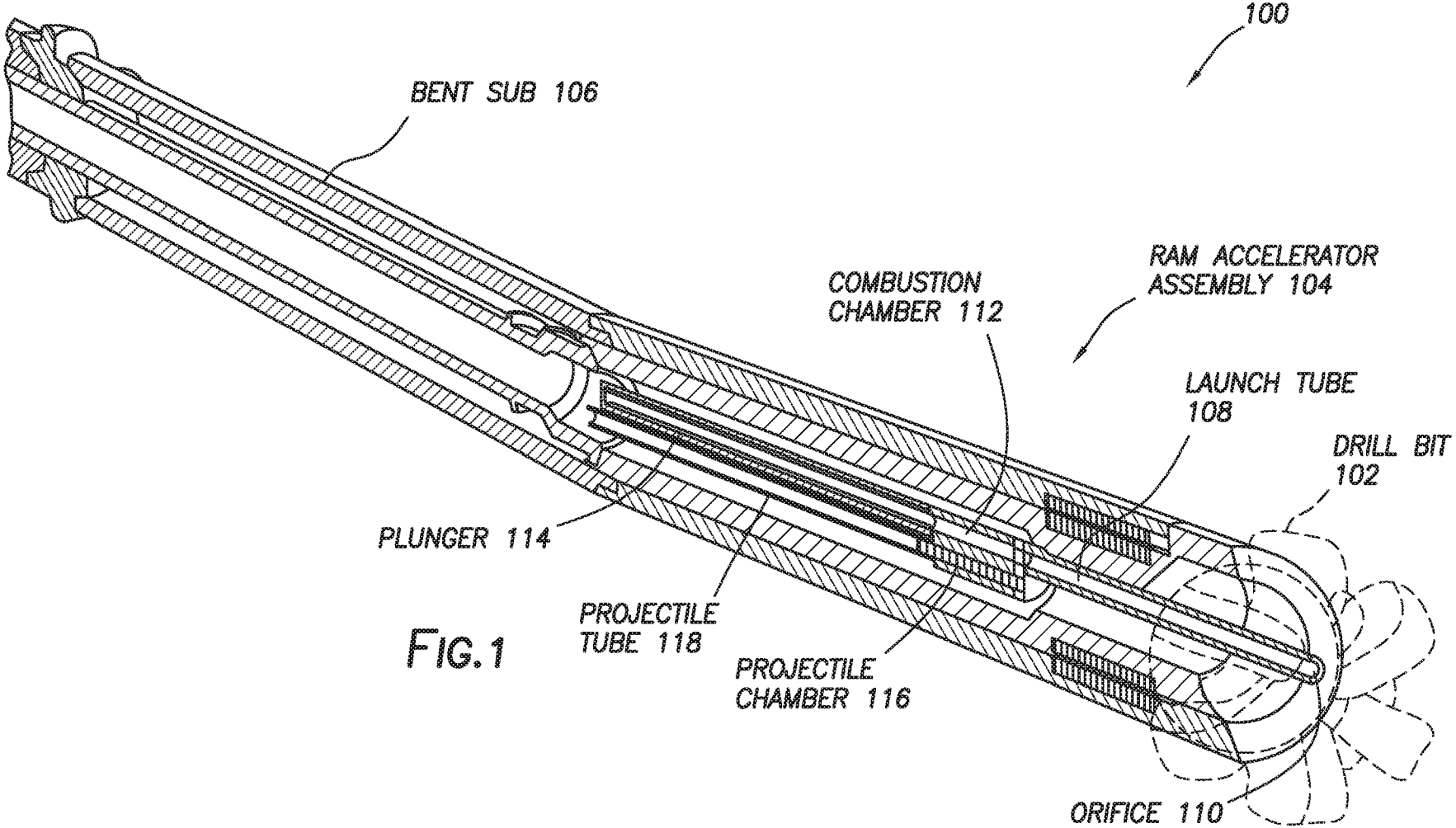
FIG. 1 depicts an illustrative system for drilling or excavating a geological formation using a drill bit in conjunction with a ram accelerator assembly, according to one implementation.

Conventional drilling and excavation techniques used for penetrating materials, such as metals, ceramics, geologic materials, and so forth, typically rely on mechanical drill bits with mechanical devices that are used to cut or grind at a working face. The mechanical devices may include teeth, cutters, and so forth. For example, a drill bit may be used to grind at a geologic formation to bore a hole used to establish water wells, oil wells, gas wells, underground pipelines, and so forth. Tool wear and breakage on the mechanical bits slows these operations, increasing costs. Furthermore, the rate of progress of cutting through material such as hard rock may be prohibitive. Additionally, the environmental impact of conventional techniques may be significant. For example, conventional drilling may require a significant supply of water which may not be readily available in arid regions. As a result, resource extraction may be prohibitively expensive, time consuming, or both.

Described in this disclosure are systems and techniques for using a ram accelerator assembly to accelerate one or more projectiles toward the working face of a geologic material. The ram accelerator assembly may utilize a combustible propellant to accelerate the projectile. Propellants may include combustible materials, such as diesel or one or more combustible gasses, or pressurized materials, such as air or another fluid. In other implementations, the source of acceleration may include an electromagnetic rail gun that uses electromagnetic fields. Use of electromagnetic systems may prolong the life of one or more components of the assembly and may reduce or eliminate the use of consumable propellant materials. Additionally, chemical energy provided into a drilling string may be used to charge electronic components, such as the electromagnetic rail gun. Alternatively, rotation of a drilling string or other downhole components may be used to actuate a downhole generator to charge electronic components. In yet another implementation, coiled tubing or an internal conduit within a drilling string may be used to provide electrical energy (e.g., high voltage) to downhole components. Projectiles accelerated using an electromagnetic rail gun may include an armature that is oriented in an upstream direction that contacts portions of the rail gun, such that as the projectile is accelerated, the armature slides along the rails of the rail gun.

The ram accelerator assembly may be used in conjunction with a mechanical drill bit for drilling or coring, such as a rotary drill bit equipped with polycrystalline diamond compact (PDC) cutting surfaces or other materials configured to remove rock or other geologic materials while rotated and lowered into the earth. Other mechanical drill bits that may be used include a tri-cone or hybrid drill bit. The type of drill bit or cutting elements used may depend on features of the geological formation, a pressure, velocity, or depth of a wellbore, a size of projectiles to be accelerated, and so forth. For example, the ram accelerator assembly may include a launch tube positioned within or beneath a length of drilling pipe, casing, coiled tubing, or another drilling conduit used to lower and provide drilling mud and rotational force to a drill bit. The launch tube may terminate at or within an orifice located in the face of the drill bit. In some implementations, the launch tube may be separated into multiple sections, each configured to hold one or more combustible gasses or other combustible materials or types of propellant. A projectile accelerated using propellant may be moved down the launch tube to exit through the orifice, through the drill bit, and impact the geologic formation.

In some implementations, a compression effect provided at least in part by a shape of the projectile may initiate combustion of the one or more combustible gasses or other materials in a ram combustion effect, accelerating the projectile. In other implementations, the combustible materials may be ignited using other means, such as a separate ignition mechanism. In some implementations, the projectile may accelerate to a hypervelocity. Hypervelocity may include velocities greater than or equal to two kilometers per second upon ejection or exit from the ram accelerator launch tube. In other implementations, the projectile may accelerate to a non-hypervelocity. Non-hypervelocity may include velocities less than two kilometers per second.

When the projectiles ejected from the launch tube strike a working face of the geologic material, projectiles travelling at hypervelocity typically interact with the geologic material at the working face as a fluid-fluid interaction upon impact, due to the substantial kinetic energy in the projectile. This interaction may form a hole that is generally in the form of a cylinder. In some cases, by firing a series of projectiles, a hole may be drilled through the geologic material. For example, a projectile having a length to diameter ratio of approximately 4:1 that impacts a formation at a velocity above approximately 800 meters/sec results in a penetration depth that is on the order of two or more times the length of the projectile. As another example, a projectile may have a length to diameter ratio of approximately 10:1. Additionally, the diameter of the hole created is approximately twice the diameter of the impacting projectile. Upon impact, the projectile may at least partially erode or vaporize due to the fluid-fluid interactions with the formation.

In comparison, projectiles travelling at non-hypervelocity may interact with the geologic material at the working face as a solid-solid interaction. This interaction may fracture or fragment the geologic material, and may form a hole which is cylindrical, or a crater having a conical profile. For example, a projectile that impacts a formation at a velocity less than 2 kilometers per second may cause geologic material proximate to the projectile to fracture and may form a crater in the impacted portion of the formation. Ejecta may be thrown from the impact site. Rather than vaporizing the projectile and a portion of the geologic material, as occurs with the fluid-fluid interaction, the solid-solid interactions between a non-hypervelocity projectile and the formation may pulverize or fracture pieces of the geologic material. In some cases, back pressure resulting from the impact may force the ejecta from the formed hole. In other cases, the flow of drilling fluid from the drill bit may carry the ejecta in an upstream direction.

Independent of the velocity of the projectile, the interactions between the accelerated projectile and the geologic material may displace, compress, remove, fracture, or otherwise weaken the geologic material. The effect of the projectile on the geologic material may enable the drill bit to bore through the weakened material with a greater rate of penetration (ROP) than if the drill bit were to be used in the absence of the accelerated projectile. By using a series of accelerated projectiles, such as one projectile every one to five seconds, to weaken the geologic formation in front of the drill bit, the ROP of a drilling operation may be substantially increased by as much as three to ten times the ROP of a drill bit used in the absence of accelerated projectiles. Additionally, wear and damage to the bit may be reduced, bits having a lower bit weight may be used, and drill bits may be rotated with less torque when compared to conventional rotary drilling operations. In some cases, the hole formed by interactions between a projectile and a geological formation may have a diameter greater than or equal to that of the drill bit.

In some implementations, one or more section separator mechanisms may be used to provide barriers between the different sections in the launch tube or other portions of the ram accelerator assembly, such as one or more internal baffles, the mechanism used to propel the projectile, chambers used to contain combustible materials, chambers used to contain projectiles, and so forth. For example, a section may be configured to contain one or more combustible gasses or other types of propellant in various conditions such as particular pressures, and so forth. Other sections of the ram accelerator assembly may contain projectiles. Section separator mechanisms may include diaphragms, valves, and so forth, which may be configured to seal one or more sections. During firing, a projectile may pass through a diaphragm, breaking the seal, or a valve may be opened prior to launch. A reel or plunger mechanism may be used to move an unused section of a diaphragm into place, restoring the seal. Other separator mechanisms such as ball valves, plates, endcaps, gravity gradient, and so forth may also be used. The separator mechanisms may be configured to operate as blow out preventers, anti-kickback devices, and so forth. For example, the separator mechanisms may comprise ball valves configured to close when pressure from down the hole exceeds a threshold pressure.

In one implementation, a plunger carrying a projectile and an endcap may be lowered through the launch tube and used to place the endcap at or near the orifice in the drill bit. Movement of the plunger and endcap through the launch tube may push drilling fluid, formation fluid or solids, or other debris, that may have entered the launch tube during movement of the drill bit, out of the launch tube, where it may be carried upstream by the flow of drilling fluid. Deposition of the endcap may prevent further entry of drilling materials into the launch tube through the orifice in the drill bit while also sealing the launch tube to enable generation of pressures sufficient to launch the projectile. As the plunger is retracted, it may deposit the projectile at a location behind the end cap. The retracting motion of the plunger and projectile may also evacuate the launch tube. A chamber or region of the launch tube behind the projectile may be filled with combustible or pressurized materials, and the ignition of the combustible materials or the pressure of the pressurized materials may cause the projectile to accelerate through the launch tube, penetrate through the endcap, exit the orifice in the drill bit, and impact the geologic formation. The projectile and at least a portion of the formation may be destroyed by the impact, generating debris, which may be carried upstream by the drilling fluid exiting the drill bit. In some cases, as the drill bit is used to bore through the region of the formation affected by the projectile, drilling fluid, formation fluid, or debris may enter the launch tube through the orifice in the drill bit. The lowering of a subsequent plunger and endcap through the launch tube may push the fluid or debris out from the tube to enable the process to be repeated. In cases where a directional drilling operation using a bent sub is performed, the launch tube may be positioned in a downstream direction relative to the bent sub in the drilling string.

In some cases, interactions between the accelerated projectile and the geologic formation may cause the projectile to be substantially pulverized. Additionally, at least a portion of the geologic formation may also be cracked, ground, pulverized, or otherwise displaced. Ejecta comprising materials resulting from the impact of one or more projectiles with the geologic material may be removed from the hole, such as by using the drilling fluid exiting the drill bit to carry the ejecta through the drilling conduit, away from the drill bit. In some implementations, a back pressure resulting from the impact may force the ejecta from the hole. In other implementations, a working fluid such as compressed air, water, and so forth may be injected into the hole to aid in removal of at least a portion of the ejecta. The injection may be done continuously, prior to, during, or after, each launch of the projectile.

In some implementations, interactions between accelerated projectiles and the formation may be used to steer a drill bit. For example, a launch tube may be oriented at an offset angle relative to the longitudinal axis of a drill bit. Projectiles may be repeatedly accelerated in a selected direction to weaken the formation on one side of the drill bit. Due to the ability of the drill bit to more easily penetrate the weakened portions of the formation, contact with unweakened portions may urge the drill bit toward the direction of the weakened portions. To facilitate penetration of the drill bit in a generally straight direction, the launch tube may be oriented to be generally parallel to and overlapping the longitudinal axis of the drill bit. In other implementations, projectiles may be fired from a launch tube that is offset relative to the longitudinal axis in an alternating or random manner. For example, if projectiles are launched in opposite directions to impact opposite sides of the formation in an alternating manner, the progress of the drill bit may continue in a generally straight direction.

The systems and techniques described may be used to reduce the time, costs, and environmental impact associated with resource extraction, resource exploration, construction, and so forth. Furthermore, the capabilities of ram accelerator drilling enable deeper exploration and recovery of natural resources. Additionally, the energy released during impact may be used for geotechnical investigation such as reflection seismology, strata characterization, and so forth.

FIG. 1 is an illustrative system 100 for drilling or excavating a geological formation using a drill bit 102 in conjunction with a ram accelerator assembly 104. The ram accelerator assembly 104 may be positioned at the downstream end of a drilling string. For example, during a directional drilling operation that uses a bent sub 106 to control the direction in which the drill bit 102 is oriented, the ram accelerator assembly 104 may be positioned downstream relative to the bent sub 106. The ram accelerator assembly 104 may include a launch tube 108, which functions as a barrel through which projectiles may be accelerated toward the drill bit 102. The launch tube 108 may terminate at an orifice 110 formed in the face of the drill bit 102, such that accelerated projectiles exit the orifice 110 to impact a portion of the geological formation located just ahead of the drill bit 102. The drill bit 102 may then be used to bore through the portion of the formation weakened by interactions with the projectile. In some implementations, the drill bit 102 or one or more other components of the drilling string, such as bearings, collars, and so forth, may serve to position the ram accelerator assembly 104 at a standoff distance from geologic material. In other implementations, the length of the launch tube 108 may affect the distance of other portions of the ram accelerator assembly 104 from the formation.

A combustion chamber 112 positioned at the upstream end of the launch tube 108 may be used to contain propellant, such as one or more combustible gasses or other combustible or pressurized materials, which may be used to accelerate a projectile seated at the upstream end of the launch tube 108 toward the orifice 110. One or more conduits extending between the combustion chamber 112 and the surface may be used to provide propellant to the combustion chamber 112. The conduit(s) may include various valves, seals, or other types of closures or backflow-preventing mechanisms to enable the combustion chamber 112 to function as a sealed or pressurized environment for combustion of the propellant. A plunger 114 may be housed in a tube located upstream of the combustion chamber 112 and used to seat projectiles and endcaps in the launch tube 108. The plunger 114 may also be used to force drilling fluid, formation fluid, or other debris that may have entered the launch tube 108 out of the orifice 110. In some implementations, the tube that houses the plunger 114 may function to provide propellant to the combustion chamber 112. For example, the channel housing of the plunger 114 may act as a conduit.

A projectile chamber 116 adjacent to the combustion chamber 112 and launch tube 108 may contain one or more projectiles and endcaps. The projectile chamber 116 may have one or more openings that communicate with the combustion chamber 112 or launch tube 108 such that projectiles and endcaps may exit the projectile chamber 116 and enter the combustion chamber 112 or launch tube 108. Subsequently, movement of the plunger 114 may be used to place the projectile and an endcap within the launch tube 108. In some implementations, projectiles and endcaps may be driven from the projectile chamber 116 into the combustion chamber 112 or launch tube 108 using motive force applied to the projectile chamber 116. For example, a projectile tube 118 that extends to the surface may be used to provide additional projectiles and endcaps to the projectile chamber 116, as well as fluid, which may be used to urge projectiles and endcaps from the projectile chamber 116 into the combustion chamber 112. Continuing the example, a closure mechanism, such as a ball valve, flapper valve, or diaphragm, may separate the projectile chamber 116 from the combustion chamber 112 or launch tube 108, until a pressure differential between the projectile chamber 116 and the combustion chamber 112 or launch tube 108 causes the closure mechanism to open, allowing passage of a projectile and endcap into the combustion chamber 112 or launch tube 108. In other implementations, a lowered pressure in the combustion chamber 112 or launch tube 108 may urge passage of a projectile and endcap from the projectile chamber 116 into the combustion chamber 112 or launch tube 108. For example, one or more of movement of the plunger 114, combustion of propellant, movement of a projectile, or destruction of the endcap may cause the pressure of the combustion chamber 112 to change relative to that of the projectile chamber 116, causing movement of a projectile and endcap into the combustion chamber 112.

In other implementations, projectiles may be provided to the launch tube 108 by flowing the projectiles into the drilling string, such as within drilling mud or another fluid. For example, one or more diverters or barriers sized to permit the passage of projectiles having a selected diameter may be used to catch projectiles travelling through the drilling string within drilling mud in a downstream direction, and channel the projectiles into the launch tube 108 or an associated projectile chamber 116. In another implementation, a drilling string may include an internal conduit through which projectiles may be provided from the surface to a lower portion of a drilling string. One example of such an internal conduit is depicted and described with reference to FIGS. 9-13.

In some implementations, separate dedicated conduits, such as the projectile tube 118, a conduit for providing propellant to the combustion chamber 112, one or more conduits for providing air to be mixed with propellant, and so forth may be used to provide materials from the surface to the ram accelerator assembly 104. In other implementations, propellant and projectiles may be provided through a single conduit, while a separate conduit may be used to provide air to the ram accelerator assembly 104. In yet another implementation, air and projectiles may be provided through a single conduit, while a separate conduit may be used to provide propellant. In still another implementation, air or propellant may be provided to the ram accelerator assembly 104 in the same conduit as the drilling fluid provided to the drill bit 102. If projectiles are provided to the ram accelerator assembly 104 concurrent with air or propellant, the projectiles may be provided with a sealing sabot or separate sealing plug between each projectile to space the projectiles and ensure that adequate propellant or air is provided between each projectile. In some cases, an inductively coupled igniter module may be provided with one or more of the projectiles.

In some implementations, one or more sensors may be configured at one or more positions along the ram accelerator assembly 104. These sensors may include pressure sensors, chemical sensors, density sensors, fatigue sensors, strain gauges, accelerometers, proximity sensors, and so forth. An electronic control system coupled to the ram accelerator assembly 104 may be used to control one or more portions thereof, such as responsive to input from the one or more sensors. The control system may comprise one or more processors, memory, interfaces, and so forth which are configured to facilitate operation of the ram accelerator assembly 104. For example, the control system may control various valves or other closure devices within the ram accelerator assembly 104, control the filling of the projectile chamber 116, the filling of the combustion chamber 112, the ignition of materials in the combustion chamber 112, and so forth. In some implementations, baffles or annular members may be placed within one or more portions of the ram accelerator assembly 104.

FIG. 2 depicts a method 200 for placing an endcap 202 and a projectile 204 within the launch tube 108 of a ram accelerator assembly 104. As described with regard to FIG. 1, a ram accelerator assembly 104 may be positioned within a drilling string proximate to the drill bit 102, such as downstream relative to a bent sub 106. The ram accelerator assembly 104 may include a launch tube 108 having an upstream end that terminates at a combustion chamber 112, and a downstream end terminating at an orifice 110 in the face of the drill bit 102. In use, pressure generated using a propellant within the combustion chamber 112 may accelerate a projectile 204 positioned within the launch tube 108 in a downstream direction toward the drill bit 102, where the projectile 204 may exit the orifice 110 to impact the geological formation in front of the drill bit 102. Subsequent operation of the drill bit 102 may cause the drill bit 102 to penetrate through the portion of the formation that is weakened by the interaction with the projectile 204.

At block 206, a plunger 114, which may be housed in a tube, conduit, or other type of housing located upstream from the launch tube 108, may be extended in a downstream direction toward the drill bit 102. The plunger 114 may carry a projectile 204 and endcap 202 that are positioned in the combustion chamber 112 or launch tube 108. For example, as described with regard to FIG. 1, a projectile 204 and endcap 202 within the adjacent projectile chamber 116 may pass into the combustion chamber 112 or launch tube 108 prior to extension of the plunger 114 toward the drill bit 102. As the plunger 114, projectile 204, and endcap 202 are advanced in a downstream direction, this motion may push drilling fluid, formation fluid, debris, or other types of ejecta 208 out of the launch tube 108, such as by urging the ejecta 208 through the orifice 110 or another opening in the drill bit 102 or launch tube 108.

At block 210, the plunger 114 may seat the endcap 202 at or near the downstream end of the launch tube 108. The endcap 202 may seal the launch tube 108, preventing entry of drilling fluid, formation fluid, debris, or other ejecta 208 from the wellbore environment. Additionally, placement of the endcap 202 may enable the launch tube 108 to be evacuated to facilitate acceleration of the projectile 204 toward the drill bit 102. For example, as the plunger 114 and projectile 204 are withdrawn in the upstream direction, this motion may evacuate the launch tube 108. In some implementations, at least a portion of the launch tube 108 may be evacuated to a pressure of 25 torr or less.

At block 212, the plunger 114 may withdraw from the launch tube 108, seating the projectile 204 at the upstream end of the launch tube 108. In some implementations, a valve 214 or other type of closure mechanism located between the launch tube 108 and combustion chamber 112 may close as the plunger 114 is withdrawn, such that the projectile 204 is seated past the valve 214 at the upstream end of the launch tube 108, proximate to the combustion chamber 112.

Figure 3:
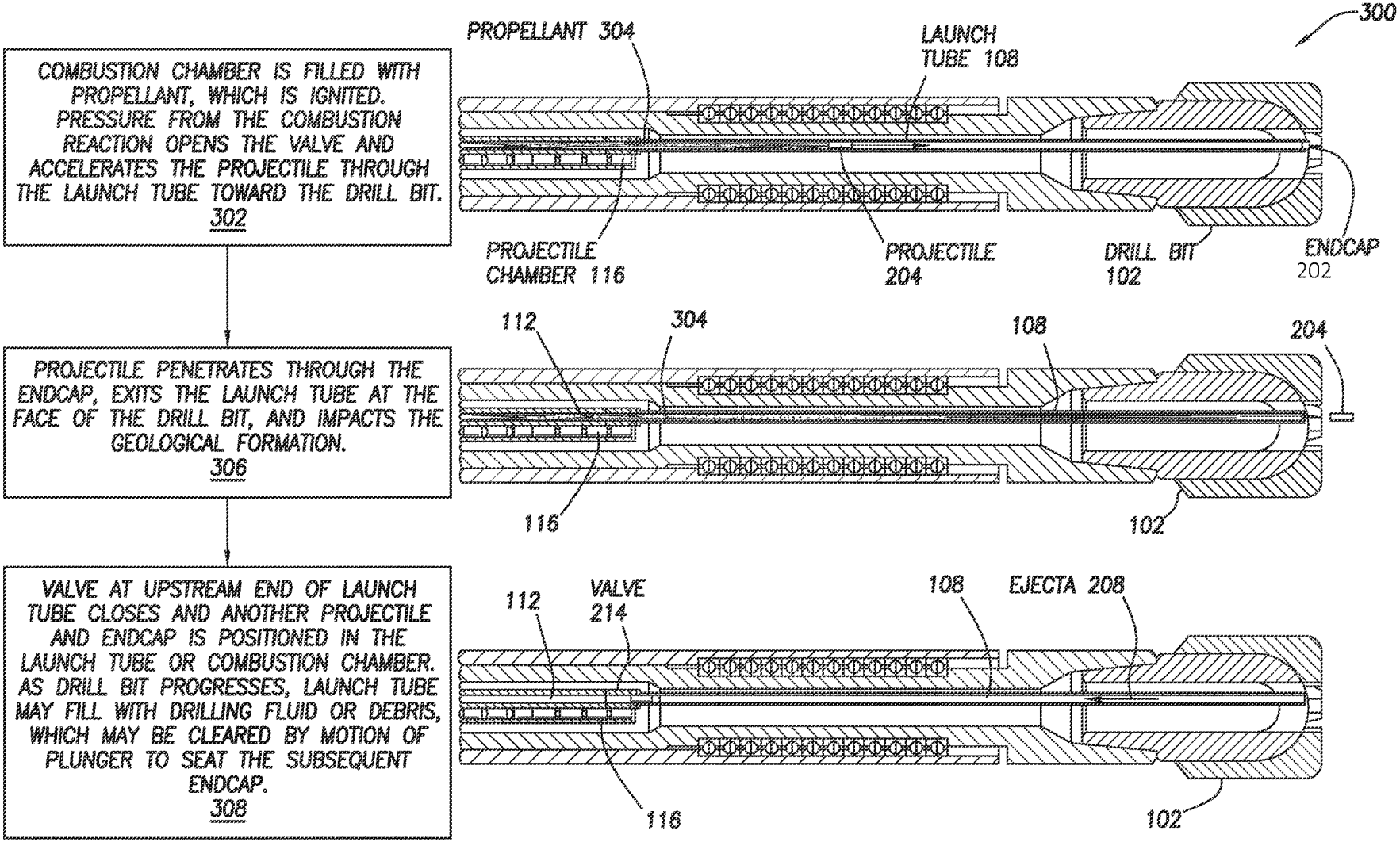
FIG. 3 depicts a method for accelerating a placed projectile through the launch tube of a ram accelerator assembly to impact a geological formation, according to one implementation.

FIG. 3 depicts a method 300 for accelerating a placed projectile 204 through the launch tube 108 of a ram accelerator assembly 104 to impact a geological formation. As described with regard to FIG. 2, a plunger 114 or similar mechanism may be used to place an endcap 202 at or near the downstream end of a launch tube 108 to seal the launch tube 108 and prevent entry of ejecta 208. Downstream movement of the plunger 114 and endcap 202 may push or wipe ejecta 208 from the launch tube 108, while upstream movement of the plunger 114 and projectile 204 after placing the endcap 202 may evacuate the launch tube 108. The projectile 204 may then be placed at or near the upstream end of the launch tube 108, such as proximate to a combustion chamber 112, on the opposite side of a valve 214 that separates the combustion chamber 112 from the launch tube 108.

At block 302, the combustion chamber 112 may be at least partially filled with propellant 304. Propellant 304 may include any manner of combustible material, pressurized material, or other types of reactants or sources of motive force that may be imparted to the projectile 204. For example, the propellant 304 may include one or more combustible gasses, which may be ignited. In some implementations, compression of the propellant 304 via upstream movement of the projectile 204 or plunger 114 may ignite or pressurize the propellant 304. In other implementations, other types of ignition may be used, such as a separate ignition mechanism. Pressure from the combustion reaction, or other type of reaction, associated with the propellant 304 may accelerate the projectile 204 through the launch tube 108 and toward the drill bit 102. In cases where a valve 214 or other closure mechanism separates the combustion chamber 112 from the launch tube 108, pressure from the propellant 304 may cause the valve 214 to open or otherwise permit passage of pressure from the propellant 304 into the launch tube 108. In some implementations, evacuation of the launch tube 108 caused by the upstream movement of the plunger 114 and projectile 204, described with regard to FIG. 2, may further increase the pressure differential between the launch tube 108 and combustion chamber 112, which may facilitate acceleration of the projectile 204 through the launch tube 108.

At block 306, the projectile 204 may penetrate through the endcap 202 and exit the launch tube 108 at the face of the drill bit 102, such as by passing through the orifice 110. The accelerated projectile 204 may then impact the geological formation ahead of the drill bit 102. Interactions between the projectile 204 and the formation may weaken the formation, enabling the drill bit 102 to penetrate through the weakened formation more efficiently than the drill bit 102 would penetrate through the formation in the absence of the projectile 204. Interactions between the projectile 204 and the formation may destroy at least a portion of the projectile 204 and the formation, and in some implementations, destroy at least a portion of the endcap 202. In other implementations, a shutter, valve, diaphragm, or other closure mechanism, may instead be used in place of the endcap 202, and passage of the projectile 204 may open the closure mechanism. The debris created by these interactions may generate ejecta 208 that may be carried toward the surface, such as by the flow of drilling fluid through the annulus in an upstream direction. In some implementations, byproducts, waste, or debris generated by combustion or discharge of the propellant 304 may also exit the launch tube 108 as ejecta 208. For example, byproducts of the propellant 304 combustion may exit the orifice 110 in the drill bit 102. In other implementations, one or more vents or other openings in the launch tube 108, drill bit 102, or combustion chamber 112 may be used to permit byproducts to flow into the annulus. In some cases, byproducts of the propellant 304 that exit the orifice 110 in the drill bit 102 or another portion of the drilling string may facilitate transport of ejecta 208 in an upstream direction.

At block 308, after the projectile 204 has exited the launch tube 108, the valve 214 at the upstream end of the launch tube 108 may close, and another projectile 204 and endcap 202 may be positioned in the launch tube 108 or combustion chamber 112 to enable the process described with regard to FIGS. 2 and 3 to be repeated. For example, a projectile 204 and endcap 202 from the projectile chamber 116 may pass into the combustion chamber 112 due to a pressure differential between the projectile chamber 116 and combustion chamber 112, subsequent to acceleration of the previous projectile 204. As the drill bit 102 progresses through the formation, the launch tube 108 may fill with drilling fluid, debris, or other ejecta 208. For example, ejecta 208 may enter the orifice 110 subsequent to destruction of the endcap 202 by the accelerated projectile 204. The ejecta 208 that enters the launch tube 108 may be cleared by motion of the plunger 114 to seat the subsequent endcap 202, as described with regard to FIG. 2.

Figure 4:
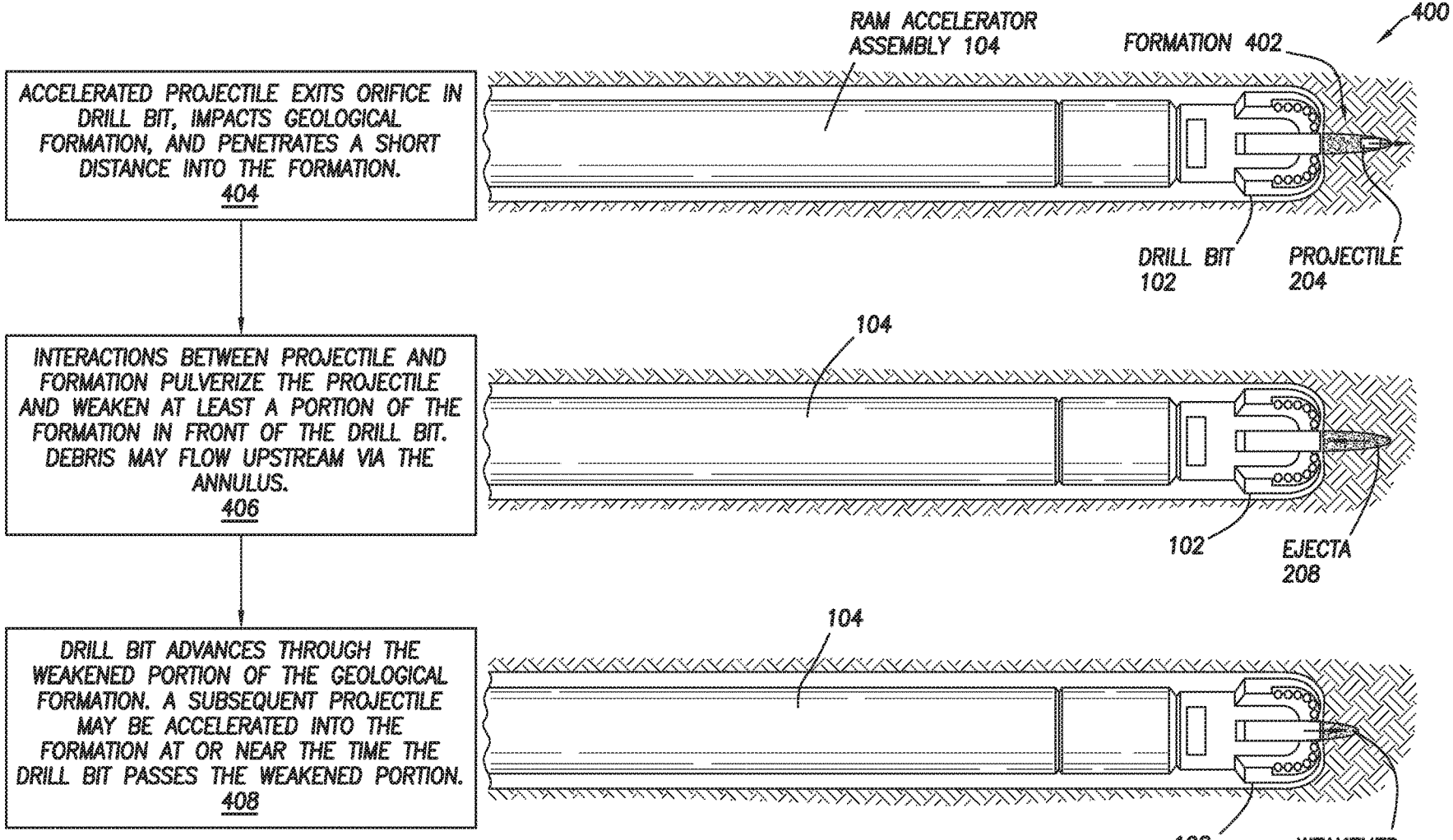
FIG. 4 depicts a method for augmenting the progress of a drill bit within a geological formation by weakening the formation using projectiles accelerated into the formation using a ram accelerator assembly, according to one implementation.

FIG. 4 depicts a method 400 for augmenting the progress of a drill bit 102 within a geological formation 402 by weakening the formation 402 using projectiles 204 accelerated into the formation 402 by a ram accelerator assembly 104. As described with regard to FIG. 3, one or more projectiles 204 may be accelerated through a launch tube 108 of a ram accelerator assembly 104. The projectile(s) 204 may exit the launch tube 108 at or near the drill bit 102 to impact a portion of the formation 402 in front of the drill bit 102. Interactions between the projectile(s) 204 and the formation 402 may weaken at least a portion of the formation 402, enabling the drill bit 102 to penetrate through the weakened portion of the formation 402 with greater efficiency than the drill bit 102 would penetrate through the formation 402 prior to interaction with the projectile 204.

At block 404, an accelerated projectile 204 may exit an orifice 110 in the drill bit 102, impact the geological formation 402, and penetrate at least a short distance into the formation 402. For example, a hypervelocity projectile 204 may interact with the formation 402 as a fluid-fluid interaction upon impact, forming a hole having a generally cylindrical shape. A non-hypervelocity projectile 204 may interact with the formation 402 as a solid-solid interaction, which may fracture or fragment a portion of the formation 402, forming a hole that may be cylindrical, a crater having a conical profile, or another shape. Independent of the velocity of the projectile 204, interactions between the accelerated projectile 204 and the geologic material may displace, compress, remove, fracture, or otherwise weaken the geologic material of the formation 402 at or near the point at which the projectile 204 impacts the formation 402.

At block 406, interactions between the projectile 204 and the formation 402 may pulverize or otherwise degrade at least a portion of the projectile 204 and weaken at least a portion of the formation 402 in front of the drill bit 102. The resulting debris may flow upstream via the annulus as ejecta 208. In some implementations, the ejecta 208 may include portions of an endcap 202 penetrated by the projectile 204, propellant 304 used to accelerate the projectile 204, byproducts from the combustion or reaction of propellant 304, and so forth. In some cases, ejecta 208 may flow into the drill bit 102, such as through an orifice 110 to enter the launch tube 108. However, the ejecta 208 may subsequently be removed from the launch tube 108 when a subsequent endcap 202 is placed at or near the drill bit 102, such as by movement of a plunger 114 carrying the endcap 202, as described with regard to FIG. 2.

At block 408, the drill bit 102 may advance through the weakened formation 410 formed by interactions with the projectile 204. For example, the weakened formation 410 may include a conical crater formed via the impact between the projectile 204 and the formation 402. Continuing the example, interactions between the formation 402 and projectile 204 may pulverize the projectile 204 and the portion of the formation 402 that occupied the crater. The pulverized debris may flow upstream from the crater as ejecta 208, while rotation and lowering of the drill bit 102 may cause the drill bit 102 to penetrate the weakened formation 410. At or near the time that the drill bit 102 passes the weakened formation 410, a subsequent projectile 204 may be accelerated into the formation 402 to weaken a subsequent portion of the formation 402.

Figure 5:
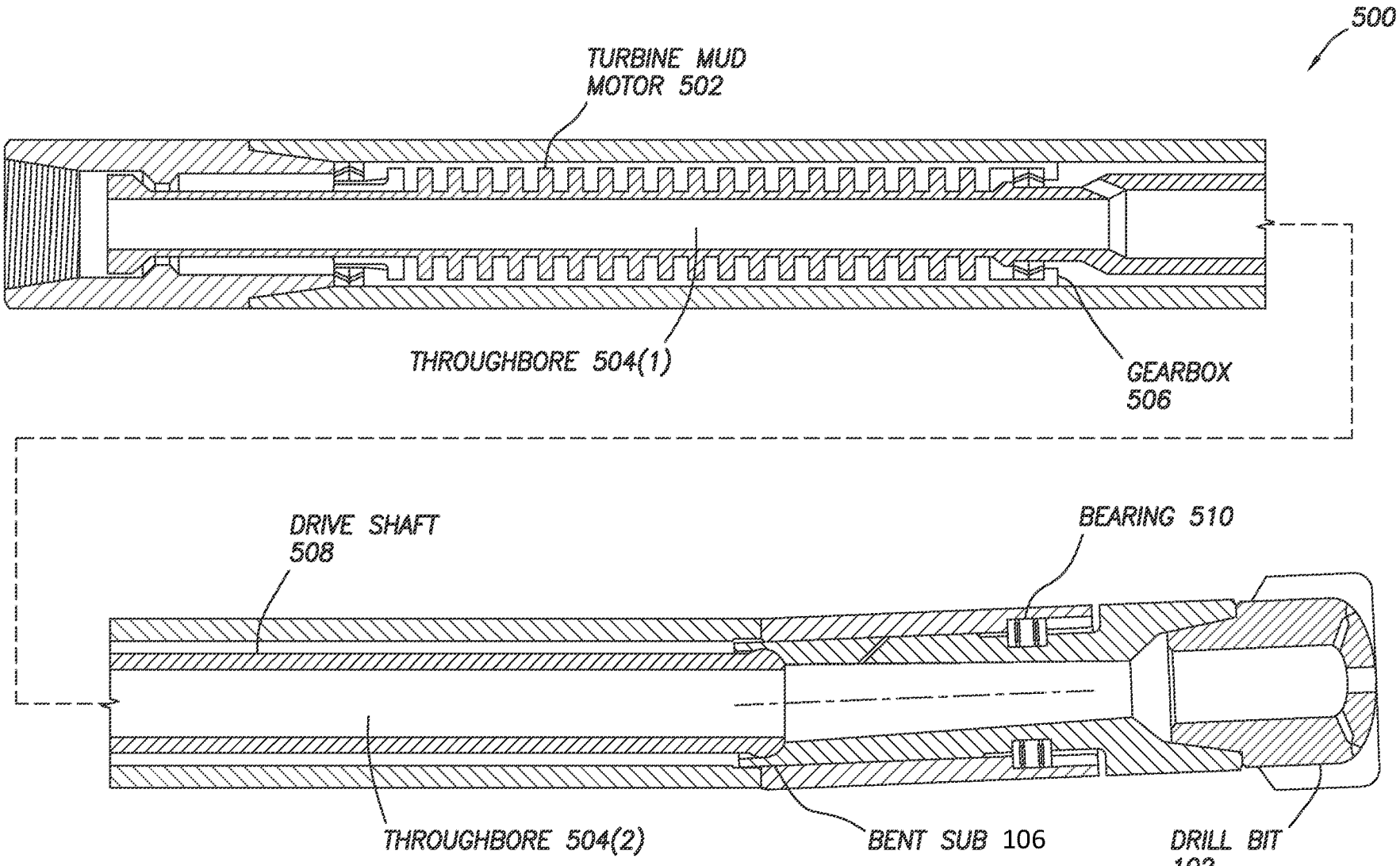
FIG. 5 depicts an illustrative system for providing solid materials such as projectiles and fluids such as propellant to the bottom of a drilling string, according to one implementation.

FIG. 5 depicts an illustrative system 500 for providing solid materials, such as projectiles 204, fluids, such as propellant 304, and electrical signals to the bottom of a drilling string. The passage of projectiles 204 into a ram accelerator assembly 104 (not shown in FIG. 5) located downstream relative to a bent sub 106 may be facilitated by a clear path, such as a central bore, extending through the elements in the drilling string located upstream from the ram accelerator assembly 104. Such components may include a mud motor, a power section, one or more measurement or logging while drilling apparatus, a steering mechanism, and so forth. Therefore, a positive displacement motor (PDM) or other type of mud motor lacking a central bore may inhibit the passage of projectiles 204 or other materials.

In the system 500 shown in FIG. 5, a turbine mud motor 502 may be used. Because a turbine mud motor 502 may be operated concentrically, rather than requiring epicyclical interactions between a motor and stator, the turbine mud motor 502 may be provided with an enlarged throughbore 504(1) to permit the passage of projectiles 204, propellant 304 and other fluids, conduits, or other materials. Because a typical turbine mud motor 502 may rotate more rapidly than a PDM, a planetary gearbox 506, or other type of gearbox 506 or transmission system, may be provided between the turbine mud motor 502 and elements of the drilling string located downstream thereof. For example, a planetary gearbox 506 having a 1:3 or 1:5 ratio may be used to step the speed of the turbine mud motor 502 downward to a speed suitable for rotation of the drill bit 102. A hollow drive shaft 508 may be used to transmit torque from the turbine mud motor 502 to the drill bit 102. The throughbore 504(1) in the turbine mud motor 502 may be contiguous with a throughbore 504(2) in the hollow drive shaft 508, enabling solids and other materials to flow through both the turbine mud motor 502 and hollow drive shaft 508 to a ram accelerator assembly 104 or other components located downstream relative to the turbine mud motor 502 and drive shaft 508. For example, FIG. 5 depicts a bent sub 106, bearing 510, and drill bit 102 located downstream of the drive shaft 508. As described with regard to FIG. 1, a ram accelerator assembly 104 may be positioned upstream relative to the drill bit 102 and downstream relative to the bent sub 106. In some implementations, one or more stabilizers may be positioned along the length of the turbine mud motor 502 to facilitate steering of the drill bit 102.

Figure 6:
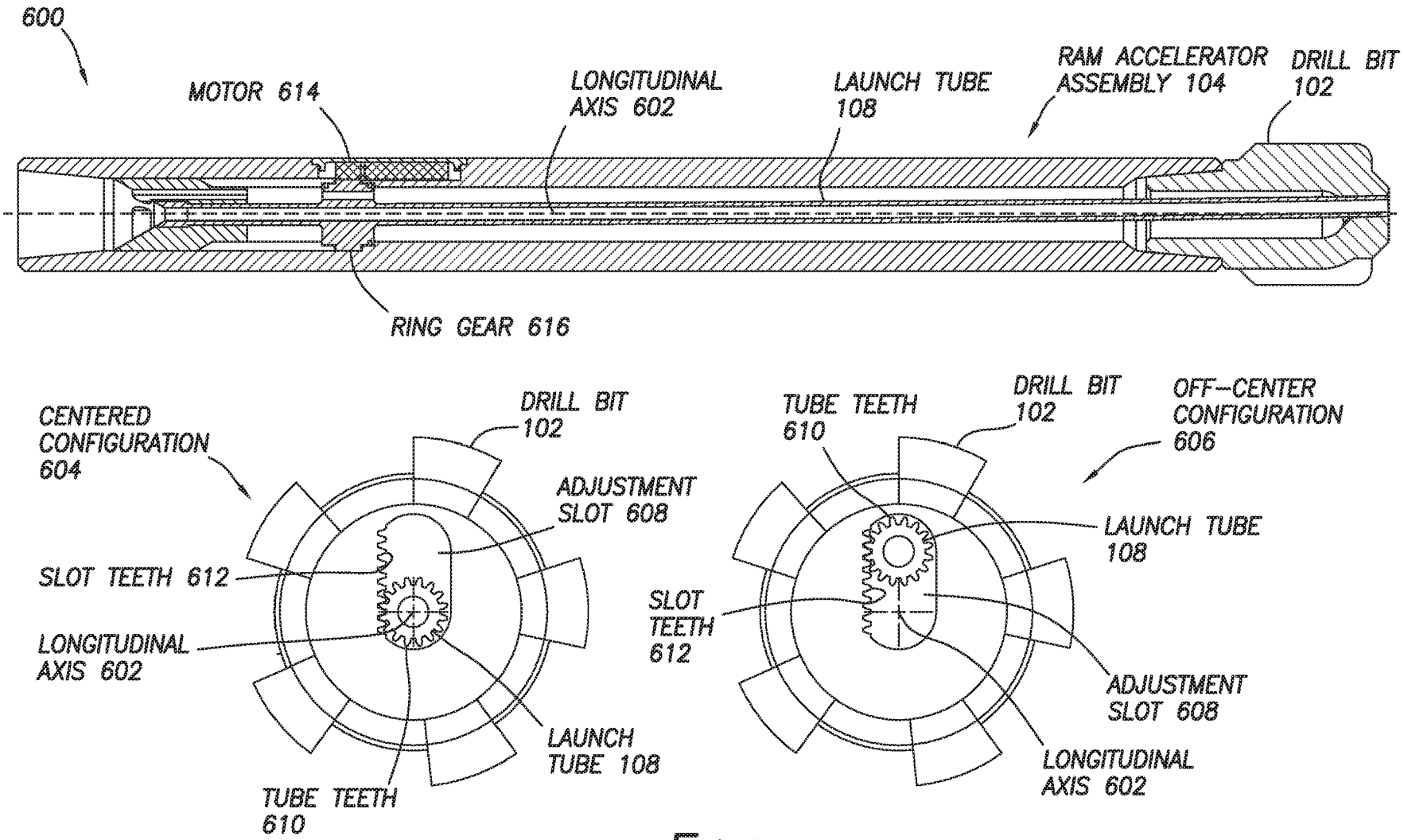
FIG. 6 depicts an illustrative system for steering a drill bit using a ram accelerator assembly, according to one implementation.

FIG. 6 depicts an illustrative system 600 for steering a drill bit 102 using a ram accelerator assembly 104. As described with regard to FIGS. 1-4, a ram accelerator assembly 104 that includes a launch tube 108 may be engaged with a drill bit 102. The ram accelerator assembly 104 may accelerate projectiles 204 through the launch tube 108, such as by using combustible propellant 304. The accelerated projectiles 204 may exit the launch tube 108 through an orifice 110 in the drill bit 102 to impact the formation 402 at or near the face of the drill bit 102. Interactions between a projectile 204 and the formation 402 may weaken the portion of the formation 402 that contacts the projectile 204, enabling the drill bit 102 to bore through the weakened portion of the formation 402 with greater efficiency than unweakened portions of the formation 402.

FIG. 6 illustrates a system 600 that may be used to selectively impact portions of the formation 402 located off-center relative to the longitudinal axis 602 of the drill bit 102. The direction in which the drill bit 102 progresses may be controlled by ejecting a projectile 204 outwards from the drill bit 102 at a selected angle relative to the longitudinal axis 602, such that the formation 402 is weakened on a particular side relative to the drill bit 102. The drill bit 102 may bore more readily through the weakened formation 410 on the particular side, while contact between the drill bit 102 and one or more unweakened portions of the formation 402 on other sides thereof may urge the drill bit 102 in the direction of the weakened portion of the formation 402.

Successive ejections of a projectile 204 may be timed using various sensors, electronics, and firing mechanisms configured to detect the rotational position of the drilling string or launch tube 108. For example, to increase the inclination of a wellbore in a desired direction, the launch tube 108 may be positioned at an offset angle relative to the longitudinal axis 602 of the drill bit 102. When one or more sensors indicate that the orifice 110 of the launch tube 108 is positioned in the desired direction relative to the longitudinal axis 602, the projectile 204 may be accelerated through the launch tube 108 and ejected into the formation 402. This off-center firing of the projectile 204 may create a weakness in the formation 402 toward one side of the drill bit 102, while contact between the drill bit 102 and unweakened portions of the formation 402 may urge the drill bit 102 toward the weakened portion of the formation 402. Each successive ejection of a projectile 204 from the launch tube 108 may be performed when the one or more sensors determine that the launch tube 108 is positioned in the desired direction relative to the longitudinal axis 602. Successive off-center ejections of projectiles 204 to weaken the formation 402 in a desired direction relative to the drill bit 102 may cause the drill bit 102 to move in the direction of the weakened formation 410, resulting in a directional steering of the drilling string using the ram accelerator assembly 104. For example, FIG. 6 depicts a side cross-sectional view of the drilling string and drill bit 102, showing the launch tube 108 of the ram accelerator assembly 104 offset (e.g., angled) relative to the longitudinal axis 602 of the drill bit 102.

In some implementations, the position of the launch tube 108 relative to the longitudinal axis 602 may be adjustable. For example, FIG. 6 depicts diagrammatic end views of the drill bit 102 and launch tube 108 that depict the launch tube 108 in a centered configuration 604 and an off-center configuration 606. The launch tube 108 may be positioned within an adjustment slot 608 that extends from the longitudinal axis 602 of the drill bit 102 to a position closer to the perimeter thereof. The launch tube 108 may be movable within the adjustment slot 608 from the centered configuration 604 to the off-center configuration 606, and to one or more positions between the centered configuration 604 and off-center configuration 606. For example, the launch tube 108 may include one or more tube teeth 610 protruding from an exterior surface thereof, or may be associated with one or more gears having the tube teeth 610 extending therefrom. The tube teeth 610 may engage a corresponding set of slot teeth 612 that extend along at least one surface of the adjustment slot 608. Thus, as the launch tube 108, or a gear associated therewith, is rotated relative to the adjustment slot 608, the tube teeth 610 may engage different portions of the slot teeth 612 as the launch tube 108 moves along the axis of the adjustment slot 608. Use of a launch tube 108 having a geared engagement with the adjustment slot 608 may enable the position of the launch tube 108 relative to the longitudinal axis 602 to be adjusted using only rotational motion, such as by controlling the rotation of the launch tube 108 relative to one or more other portions of the drilling string. Engagement between the tube teeth 610 and slot teeth 612 may prevent unintended movement of the launch tube 108 relative to the drill bit 102 that may be caused by motion of the drill bit 102 or drilling string during operation, such that the launch tube 108 may be positioned and maintained at a selected angle relative to the longitudinal axis 602.

In one implementation, a motor 614 within the ram accelerator assembly 104 may engage a ring gear 616 or other protruding member associated with the launch tube 108. The motor 614 may be used to impart rotational force to the ring gear 616, which may cause rotation of the launch tube 108 relative to the drill bit 102, moving the end of the launch tube 108 within the adjustment slot 608. The motor 614 may communicate with one or more sensors for detecting the angular position of the launch tube 108, the rotational position of the drill bit 102, the rotational speed of one or more components within the drilling string, and so forth. For example, the speed and direction of the rotational force imparted to the ring gear 616 by the motor 614 for adjustment of the launch tube 108 may be selected based on the current rotational speed of the drill bit 102 and drilling string.

In other implementations, the launch tube 108 may be provided with a fixed offset orientation relative to the drill bit 102 and may selectively be used to steer the drill bit 102 in a straight or directional orientation based on the time at which projectiles 204 are launched. For example, to steer the drill bit 102 in a selected direction, one or more sensors may be used to determine when the end of the launch tube 108 is positioned toward a side of the drill bit 102 that corresponds to the selected direction. Projectiles 204 may be ejected from the launch tube 108 at times when the projectiles 204 will be launched in the selected direction, to impact a portion of the formation 402 located in the selected direction. Interactions with the projectile 204 may weaken that portion of the formation 402, such that the drill bit 102 is urged toward the selected direction by unweakened portions of the formation 402. To facilitate the progress of the drill bit 102 in a generally straight direction, the sensor(s) may be used to determine the position of the end of the launch tube 108, and successive projectiles 204 may be ejected in different directions in an alternating manner. For example, successive projectiles 204 may be ejected toward opposing sides of a borehole in an alternating manner, toward four or more equally spaced points along the perimeter of a borehole in a clockwise, counterclockwise, alternating, or random manner, and so forth.

In still other implementations, a launch tube 108 may be provided with a fixed offset relative to the drill bit 102, but the launch tube 108 may be configured to remain stationary relative to the borehole while the drill bit 102 rotates. For example, a swivel joint or other type of movable joint may be provided between the drill bit 102 and the launch tube 108.

Figure 7:
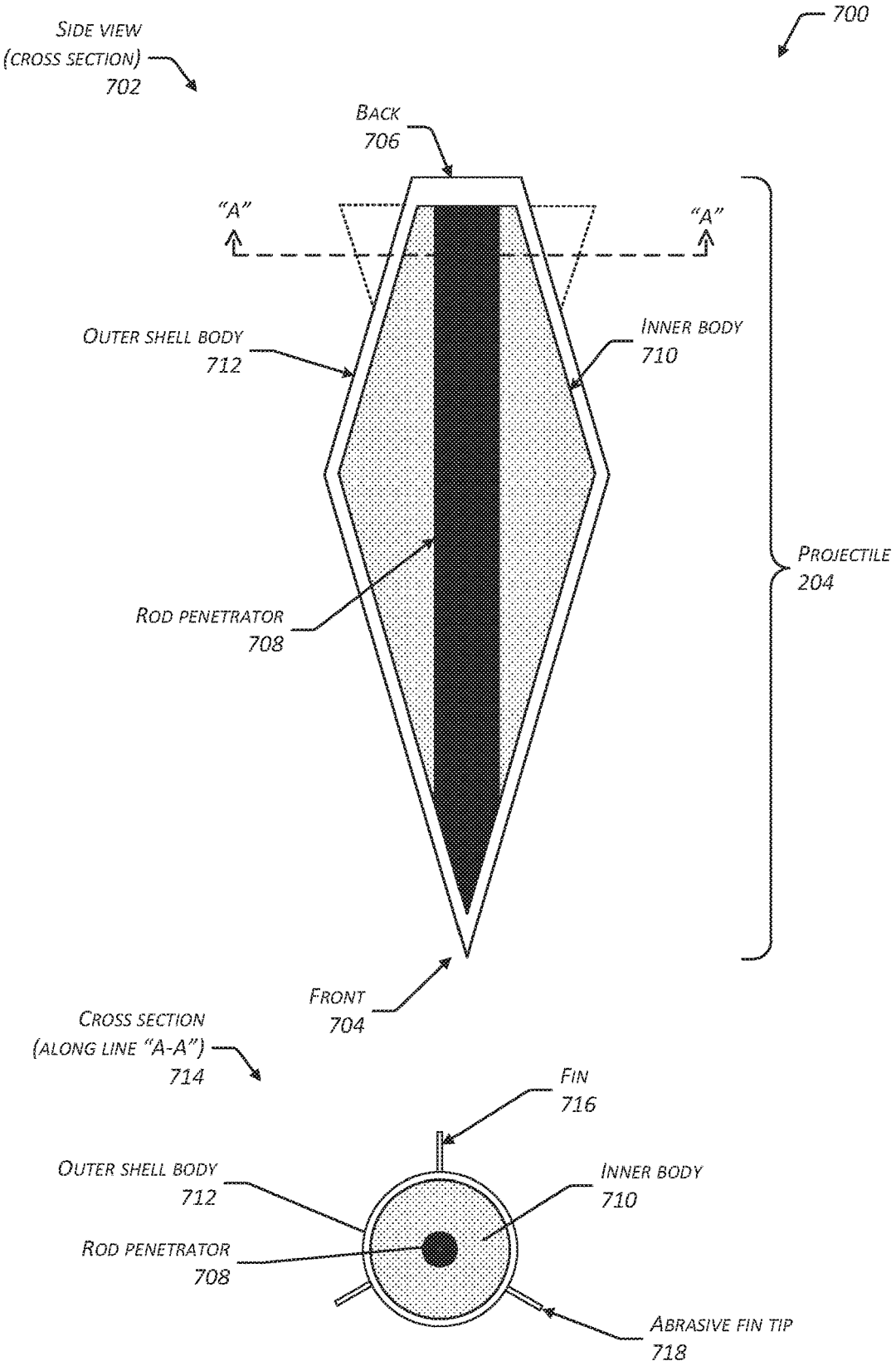
FIG. 7 illustrates two views of an example implementation of a projectile, according to one implementation.

FIG. 7 illustrates two views 700 of an example implementation of a projectile 204. A side-view 702 depicts the projectile 204 as having a front 704, a back 706, a rod penetrator 708, an inner body 710, and an outer shell body 712. The front 704 is configured to exit the launch tube 108 before the back 706 during launch.

The rod penetrator 708 may comprise one or more materials such as metals, ceramics, plastics, and so forth. For example, the rod penetrator 708 may comprise copper, depleted uranium, and so forth. The inner body 710 of the projectile 204 may comprise a solid plastic material or other material to entrain into the weakened portion of the formation 402, such as explosives, hole cleaner, seepage stop, water, ice, and so forth.

In some implementations, at least a portion of the projectile 204 may comprise a material which is combustible during conditions present during at least a portion of the firing sequence of the ram accelerator assembly 104. For example, the outer shell body 712 may comprise aluminum. In some implementations, the projectile 204 may omit onboard propellant 304. In other implementations, the projectile 204 may include an oxidizer, such as ammonium perchlorate or sodium perchlorate, which may interact with diesel or another material contained within a portion of the drilling string to propel the projectile 204 in a downstream direction. In still other implementations, the projectile 204 may include materials configured to convert to gas as the projectile 204 travels down the drilling string or launch tube 108, the gas accelerating the projectile 204. For example, a projectile 204 may include a metal or ceramic body facing the drill bit 102 and a solid, gas generating component positioned in an upstream direction relative to the body. The gas generating component may be slowly combusted, or more quickly combusted through use of metal accelerants or other types of accelerants, to propel the projectile 204 using the generated gas. In some implementations, the gas generating component may be disassembled from the remainder of the projectile 204 within the drilling string.

The back 706 of the projectile 204 may also comprise an obturator which may prevent the escape of propellant 304 past the projectile 204 as the projectile 204 accelerates through the launch tube 108. The obturator may be an integral part of the projectile 204 or a separate and detachable unit. A cross section 714 illustrates a view along the plane indicated by line A-A.

As depicted, the projectile 204 may also comprise one or more fins 716, rails, or other guidance features. For example, the projectile 204 may be rifled to induce spiraling. The fins 716 may be positioned to the front 704 of the projectile 208, the back 706, or both, to provide guidance during launch and ejection. The fins 716 may be coated with an abrasive material that aids in cleaning the launch tube 108 as the projectile 204 is accelerated to penetrate the formation 402. In some implementations, one or more of the fins 716 may comprise an abrasive fin tip 718. In some implementations, the body of the projectile 204 may extend outwards to form a fin 716 or other guidance feature. The abrasive fin tip 718 may be used to clean the launch tube 108 during passage of the projectile 204.

In some implementations, the projectile 204 may incorporate one or more sensors or other instrumentation. The sensors may include accelerometers, temperature sensors, gyroscopes, and so forth. Information from these sensors may be returned to receiving equipment using radio frequencies, optical transmission, acoustic transmission, and so forth. This information may be used to modify the one or more firing parameters, characterize material in the formation 402, and so forth.

Figure 8:
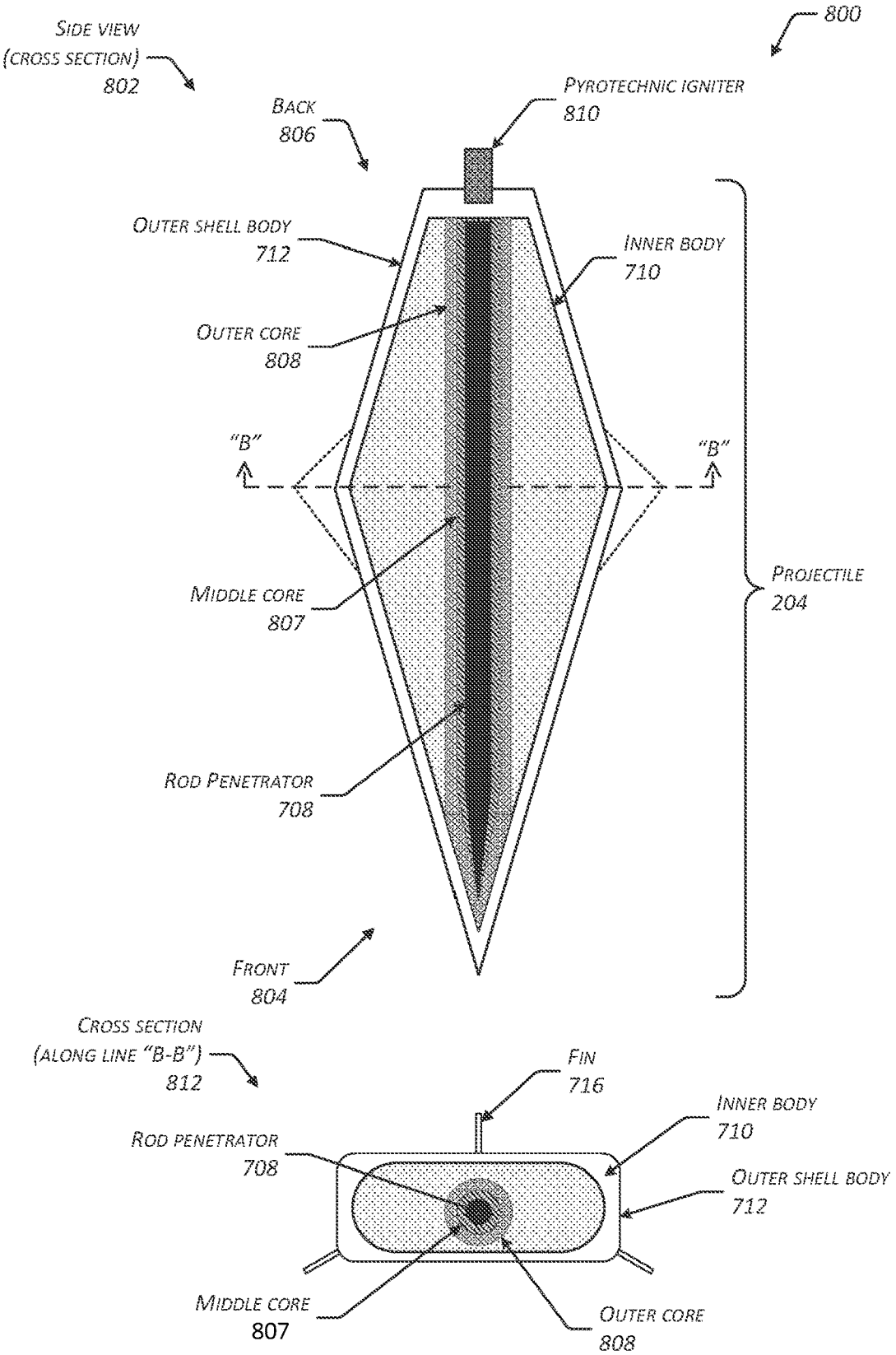
FIG. 8 illustrates two views of an example implementation of a projectile, according to one implementation.

FIG. 8 illustrates two views 800 of another example implementation of a projectile 204 design. FIG. 8 includes a side view 802 showing a cross section, in which the projectile 204 has a front 804 and a back 806.

Within the projectile 204 is the rod penetrator 708. While the penetrator is depicted as a rod, in other implementations the penetrator may have one or more other shapes, such as a prismatic solid.

The projectile 204 may include a middle core 807 and an outer core 808. In some implementations, one or both of these may be omitted. As described above, the projectile 204 may include the inner body 710 and the outer shell body 712. FIG. 8 depicts the inner body 710 and outer shell body 712 having a different shape than that depicted in FIG. 7.

The projectile 204 may comprise a pyrotechnic igniter 810. The pyrotechnic igniter 810 may be configured to initiate, maintain, or otherwise support combustion of the propellant 304 during firing.

The cross section 812 illustrates a view along the plane indicated by line B-B. As depicted, the projectile 204 may not be radially symmetrical. In some implementations, the shape of the projectile 204 may be configured to provide guidance or direction to the projectile 204. For example, the projectile 204 may have a wedge or chisel shape. As described with regard to FIG. 7, the projectile 204 may also comprise one or more fins 716, rails, or other guidance features.

The projectile 204 may comprise one or more abrasive materials. The abrasive materials may be arranged within or on the projectile 204 and configured to provide an abrasive action upon impact with the formation 402. In some implementations, the abrasive materials may include one or more of diamond, garnet, silicon carbide, tungsten, or copper. For example, a middle core 807 may comprise an abrasive material that may be layered between the inner core and the outer core 808 of the rod penetrator 708.

FIGS. 9-12 illustrate a method for fitting an existing conduit, such as a length of drill pipe, with an internal conduit that may be used to provide solids, fluids, gasses, electrical signals, electrical power, and so forth from the surface to the bottom of a wellbore. For example, projectiles 204, endcaps 202, propellant 304, and so forth may be provided to a ram accelerator assembly 104 through an internal conduit that has been installed within segments of a drilling string. For example, electrical conductors, such as wiring, may pass through the internal conduit. In another example, the conduit itself may be used as an electrical conductor.

Figure 9:
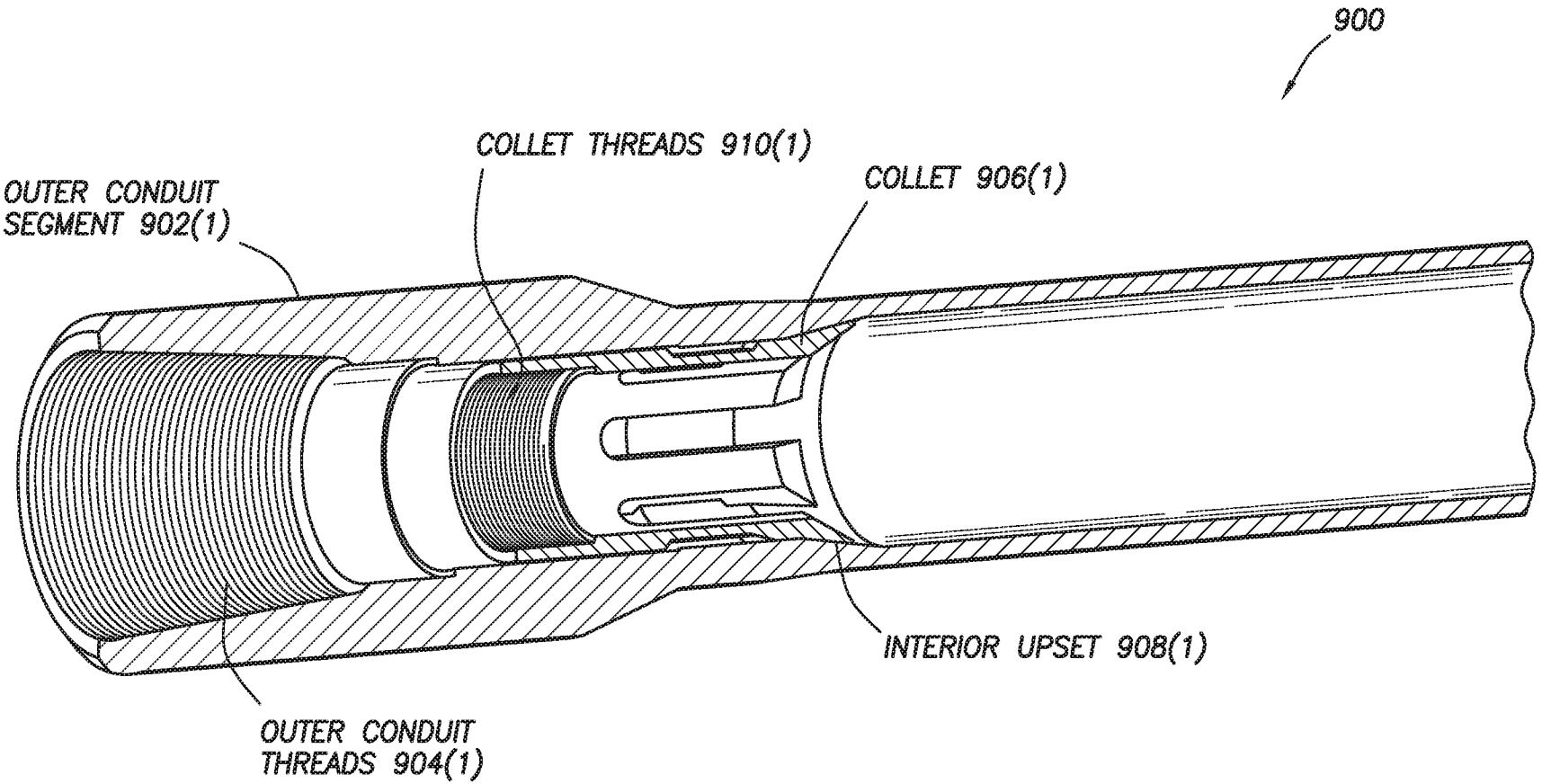
FIGS. 9-13 illustrate cut-away views of outer conduit segments and a method for installing an inner conduit segment within an outer conduit to enable provision of projectiles or other materials through the inner conduit, according to one implementation.

FIG. 9 is a cut-away view 900 illustrating a first outer conduit segment 902(1). The outer conduit segments 902(1) may include a length of drill pipe configured for engagement with other outer conduit segments 902. In other implementations, the outer conduit segment 902(1) may include another type of conduit, such as casing, tubing, and so forth. The outer conduit segment 902(1) may include a set of outer conduit threads 904(1) used to engage the outer conduit segments 902 to one another. For example, the first outer conduit segment 902(1) may include a set of interior (e.g., female) outer conduit threads 904(1), which may be engaged with a complementary set of exterior (e.g., male) outer conduit threads 904 formed on an adjacent outer conduit segment 902 to form a continuous segment of a drilling string or other type of conduit.

To secure an inner conduit within the outer conduit segments 902(1), a collet 906(1) may be inserted and installed into the outer conduit segment 902(1). For example, the collet 906(1) may include one or more protruding elements that are biased outwards from a central body. The protruding members of the collet 906(1) may extend outwards to engage an interior upset 908(1), such as a shoulder or angled surface, within the first outer conduit segment 902(1). For example, during construction, portions of a section of drill pipe that include threads are typically welded to the remainder of the drill pipe section. The interior upset 908(1) may include a protruding region within the interior of the outer conduit segment 902(1) where the threaded portion was joined to the remainder of the outer conduit segment 902(1). In some implementations, at least a portion of the outer surface of the collet 906(1) may be knurled or otherwise textured to increase friction between the collet 906(1) and the interior surface of the outer conduit segment 902(1). The collet 906(1) may include a set of collet threads 910(1) positioned on the interior surface thereof for engagement with other members used to secure the inner conduit within the outer conduit segment 902(1).

Figure 10:
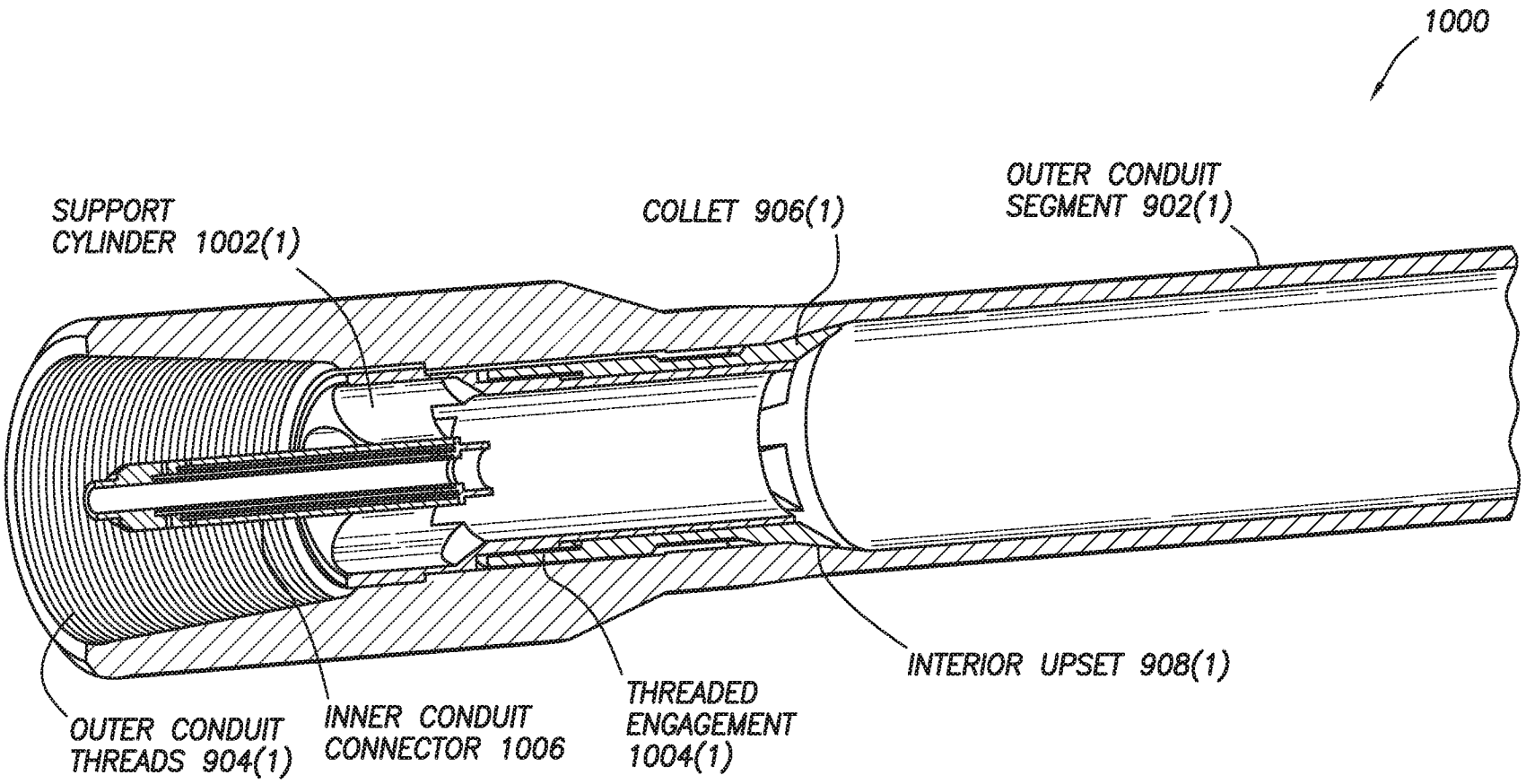

FIG. 10 is a cut-away view 1000 illustrating the first outer conduit segment 902(1) having a first support cylinder 1002(1) engaged to the installed collets 906(1). The first support cylinder 1002(1) may include exterior threads complementary to the collet threads 910(1) of the collet 906(1), such that the support cylinder 1002(1) may be engaged with the collet 906(1) via a threaded engagement 1004(1). Tightening of the threaded engagement 1004(1) between the support cylinder 1002(1) and collet 906(1) may restrict the collet 906(1) from compressing and place the collet 906(1), support cylinder 1002(1), and one or more attached segments of the inner conduit into tension. In some implementations, at least a portion of the exterior surface of the support cylinder 1002(1) may be knurled or otherwise textured to frictionally secure the support cylinder 1002(1) relative to the outer conduit segment 902(1) or the collet 906(1). The support cylinder 1002(1) may include or be engaged with an inner conduit connector 1006, which may be used to engage and connect segments of an inner conduit extending within one or more outer conduit segments 902.

Figure 11:
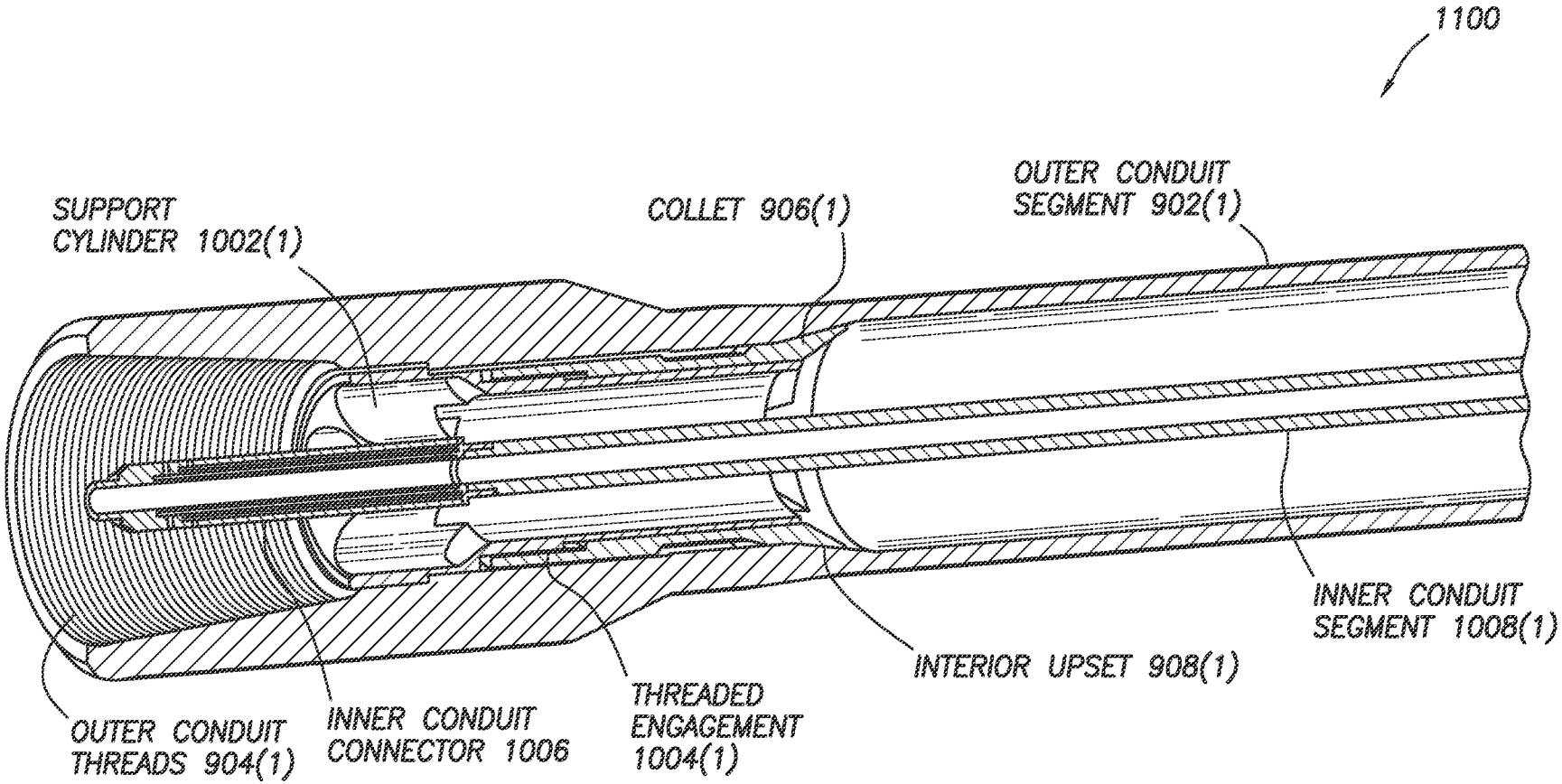

For example, FIG. 11 depicts a cut away view 1100 showing the support cylinder 1002(1) and collet 906(1) installed within the outer conduit segment 902(1), with a first inner conduit segment 1008(1) engaged with the inner conduit connector 1006. The inner conduit segment 1008(1) may extend a selected length within the outer conduit segment 902(1), where the inner conduit segment 1008(1) may engage an additional inner conduit connector 1006 supported by a corresponding collet 906 and support cylinder 1002. For example, each end of an outer conduit segment 902 may include a collet 906 and support cylinder 1002, and a single inner conduit segment 1008 may extend along the length of the outer conduit segment 902. The collet 906 and support cylinder 1002 at the first end of an outer conduit segment 902 may include an inner conduit connector 1006, while the collet 906 and support cylinder 1002 at an opposing end may not include the inner conduit connector 1006 and may instead be configured to mate with an end of an adjacent outer conduit segment 902 that includes an inner conduit connector 1006.

Figure 12:
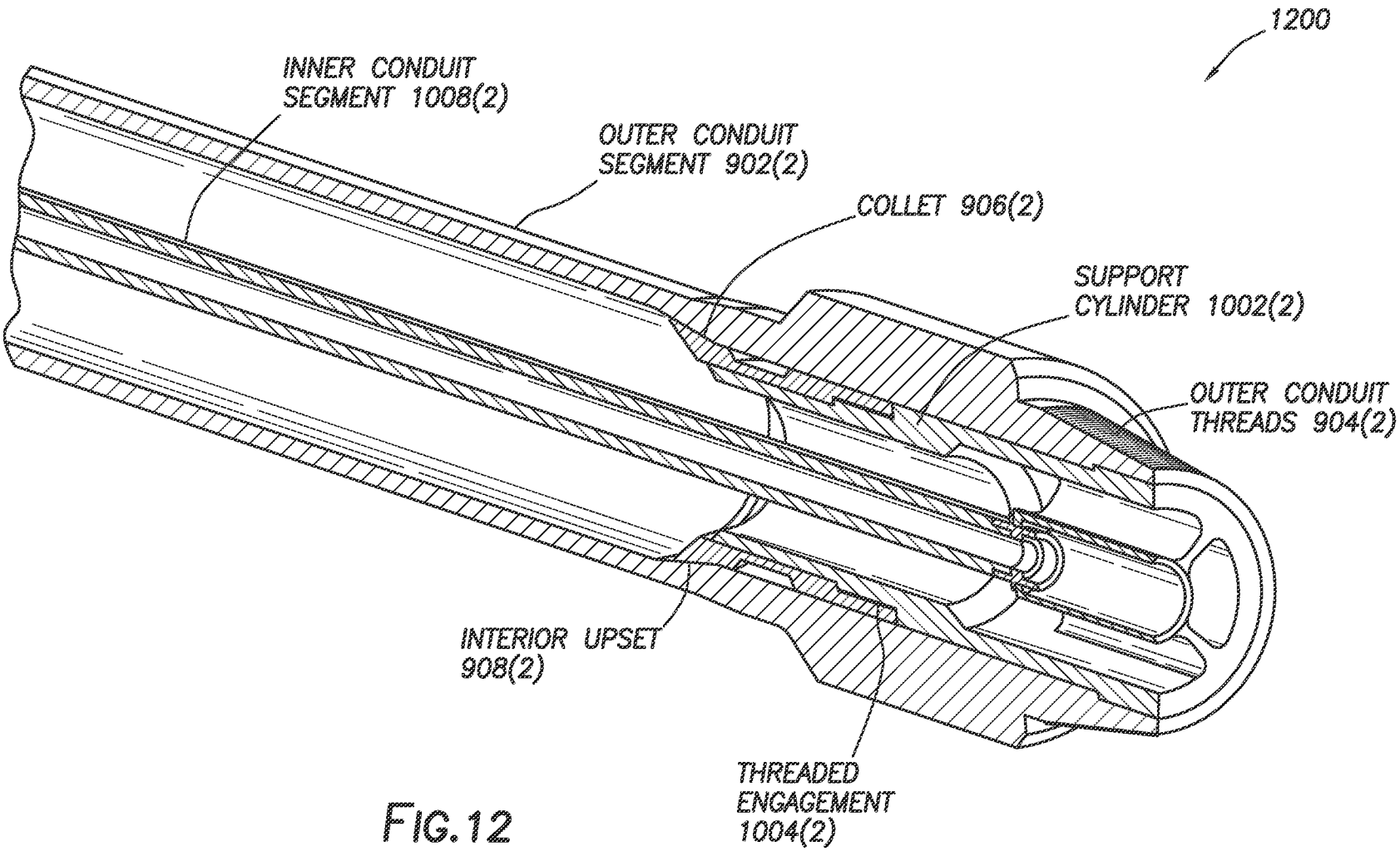

For example, FIG. 12 depicts a cut-away view 1200 showing a second outer conduit segment 902(2) having a set of outer conduit threads 904(2) that may be complementary to and configured to mate with the outer conduit threads 904(1) of the first outer conduit segment 902(1), shown in FIGS. 9-11. A second collet 906(2) may be installed within the second outer conduit segment 902(2) by permitting protruding members thereof to extend and engage an interior upset 908(2) within the second outer conduit segment 902 (2). A second support cylinder 1002(2) may be engaged with the second collet 906(2) via a threaded engagement 1004(2). The second collet 906(2) and second support cylinder 1002 (2) may be substantially identical to the collet 906(1) and support cylinder 1002(1) shown in FIGS. 9-11. FIG. 12 also depicts a second inner conduit segment 1008(2) supported by the second support cylinder 1002(2). However, the assembly shown in FIG. 12 lacks an inner conduit connector

1006, such that the end of the second inner conduit segment 1008(2) may receive an end of the inner conduit connector 1006 supported in an adjacent outer conduit segment 902, such as the first outer conduit segment 902(1) shown in FIGS. 9-11.

Figure 13:
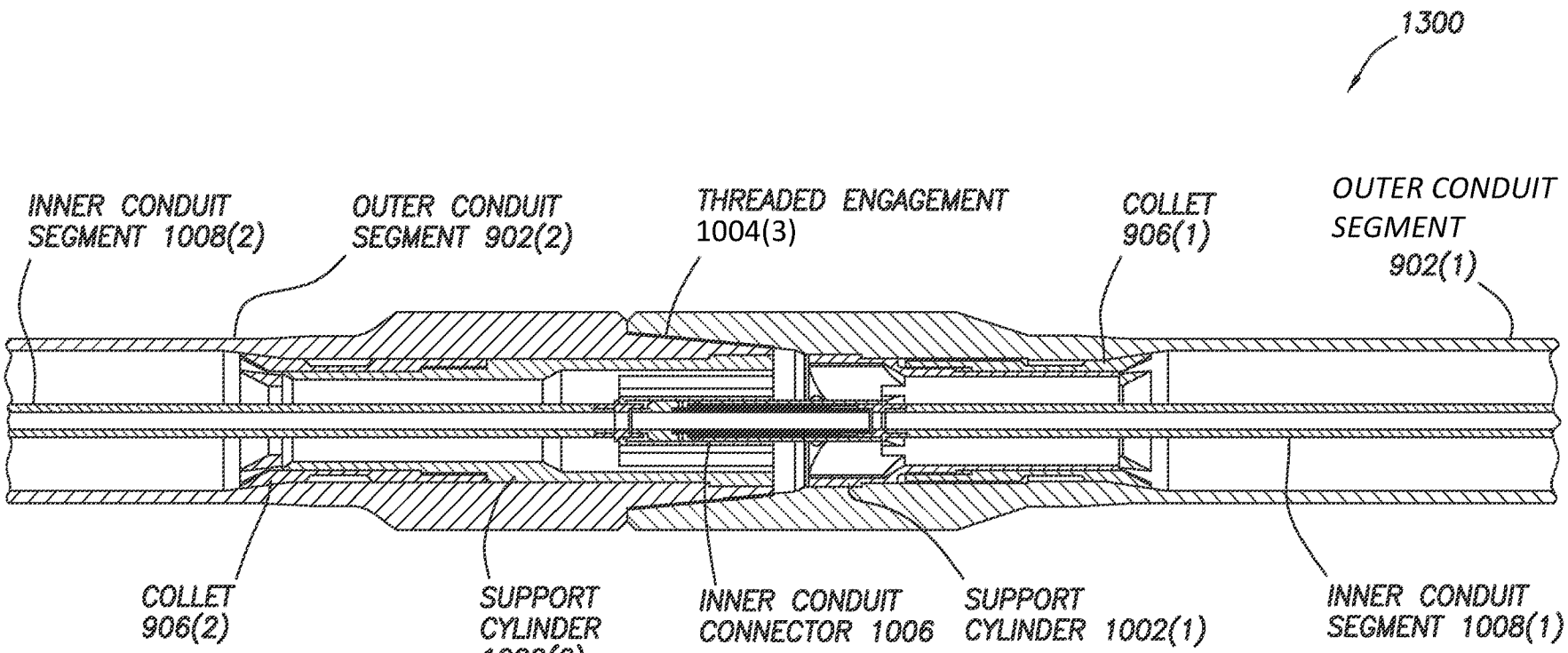

FIG. 13 depicts a cut-away view 1300 showing an engagement between the first outer conduit segment 902(1) of FIGS. 9-11 and the second outer conduit segment 902(2) via a threaded engagement 1004(3) mating the first outer conduit threads 904(1) with the second outer conduit threads 904(2). Due to the alignment of the first inner conduit segment 1008(1), second outer conduit segment 902(2), and inner conduit connector 1006 supported by the support cylinders 1002, mating of the outer conduit segments 902 may also cause mating of one of the inner conduit segments 1008 with the inner conduit connector 1006 to form a continuous inner conduit extending through the interior of the engaged outer conduit segments 902. The inner conduit may be used, for example, to provide projectiles 204, propellant 304, or other solids, liquids, or gasses to a ram accelerator assembly 104 or other drill string component from the surface, or to transport materials to the surface from a location within the drill string. By installing collets 906 and support cylinders 1002 at each end of an outer conduit segment 902, an inner conduit segment 1008 may be installed within the outer conduit segment 902, supported by the support cylinders 1002. Inner conduit segments 1008 may be installed within multiple outer conduit segments 902, such that as the outer conduit segments 902 are mated (e.g., via extension of a drilling string during drilling operations), a continuous inner conduit is also formed.

CLAUSES

Further applications of the systems and techniques described herein may be used to launch projectiles aerially. For example, a payload may be launched into a sub-orbital or orbital trajectory using the techniques described herein. In other implementations, systems and techniques described herein may be used to launch projectiles in a marine setting, such as during subsea or underwater drilling or mining operations.

Those having ordinary skill in the art will readily recognize that certain steps or operations illustrated in the figures above can be eliminated, combined, subdivided, executed in parallel, or taken in an alternate order. Moreover, the methods described above may be implemented as one or more software programs for a computer system and are encoded in a computer-readable storage medium as instructions executable on one or more processors. Separate instances of these programs can be executed on or distributed across separate computer systems.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art and it is intended that the present disclosure encompass such changes and modifications that fall within the scope of the appended claims.

Embodiments may be described in view of the following clauses:

1. A system to drill into a geological formation, the system comprising:
   a mechanical drill bit comprising:
      one or more devices to displace material from the geological formation; and
      an orifice;
   an assembly including:
      a projectile chamber;
      a combustion chamber; and
      a launch tube extending from the combustion chamber to the orifice in the mechanical drill bit.
2. The system of clause 1, further comprising:
   a plunger to position one or more of an endcap and a projectile into the launch tube, wherein retraction of the plunger from the launch tube evacuates a portion of the launch tube upstream of the endcap.
3. The system of clause 1 or 2, wherein the projectile chamber is configured to hold one or more projectiles and endcaps, and further wherein responsive to a pressure differential between the projectile chamber and the combustion chamber, a projectile and an endcap are passed from the projectile chamber into the launch tube.
4. The system of any of clauses 1 through 3, further comprising a conduit in communication with the projectile chamber, wherein the conduit is configured to transport projectiles to the projectile chamber.
5. The system of any of clauses 1 through 4, further comprising a conduit in communication with the combustion chamber, wherein the conduit is configured to deliver propellant to the combustion chamber.
6. The system of any of clauses 1 through 5, further comprising:
   a bent sub positioned such that the assembly is between the bent sub and the mechanical drill bit.
7. The system of any of clauses 1 through 6, further comprising:
   a turbine mud motor engaged with the bent sub via a drive shaft, wherein the turbine mud motor and the drive shaft comprise a throughbore that permits passage of one or more of a projectile or propellant.
8. The system of any of clauses 1 through 7, wherein the launch tube is movable relative to a longitudinal axis of the drill bit between a first position in which an end of the launch tube is generally parallel to the longitudinal axis and a second position in which the end of the launch tube is non-parallel relative to the longitudinal axis.
9. The system of clause 8, further comprising:
   a first set of teeth arranged on an exterior of the launch tube;
   the mechanical drill bit further comprising:
   an adjustment slot extending from a position that is proximate to a center of the mechanical drill bit to a position that is off-center, wherein the adjustment slot comprises a second set of teeth configured to engage the first set of teeth.
10. A method comprising:
   positioning an endcap at a first end of a launch tube using a plunger, wherein the first end extends proximate to an orifice in a drill bit;
   positioning a projectile at a second end of the launch tube using the plunger;
   propelling the projectile through the endcap such that the projectile exits the launch tube and impacts a portion of a geological formation; and moving the drill bit towards the portion of the geological formation.

11. The method of clause 10, further comprising:

directing a path of the drill bit through the geological formation by preferentially launching projectiles to a particular side of a hole.

12. The method of clause 10 or 11, further comprising:

transporting the projectile to a projectile chamber using a conduit; and moving the projectile from the projectile chamber to the launch tube.

13. The method of any of clauses 10 through 12, further comprising:

evacuating at least a portion of the launch tube using the plunger.

14. The method of any of clauses 10 through 13, further comprising:

positioning the first end of the launch tube at an offset angle relative to a longitudinal axis of the drill bit, such that the launch tube is non-parallel to the longitudinal axis;

determining that the first end of the launch tube is positioned toward a first side of the drill bit relative to the longitudinal axis; and igniting a propellant responsive to the determining that the first end of the launch tube is positioned toward the first side.

15. The method of any of clauses 10 through 14, further comprising:

moving, responsive to a pressure differential, the projectile from a projectile chamber to a combustion chamber that is in communication with the launch tube;

filling the combustion chamber with a propellant; and igniting the propellant within the combustion chamber.

16. A system comprising:

a drill bit comprising:

one or more devices to displace material; and an orifice extending through the drill bit;

an assembly including:

a combustion chamber;

a launch tube extending from the combustion chamber to the orifice in the drill bit.

17. The system of clause 16, further comprising:

a plunger to:

position an endcap in the launch tube proximate to the orifice; and evacuate a portion of the launch tube upstream of the endcap upon withdrawal of the plunger.

18. The system of clause 16 or 17, wherein the launch tube is movable relative to a longitudinal axis of the drill bit between a first position in which an end of the launch tube is generally parallel to the longitudinal axis and a second position in which the end of the launch tube is non-parallel relative to the longitudinal axis.

19. The system of any of clauses 16 through 18, further comprising:

a plunger; and a closure mechanism separating the projectile chamber from the launch tube, wherein the plunger is configured to move a projectile from a first position in the projectile chamber on a first side of the closure mechanism to a second position within the launch tube on a second side of the closure mechanism.

20. The system of any of clauses 16 through 19, further comprising:

an endcap within the launch tube between the orifice and a projectile, wherein the endcap is configured to be penetrated by the projectile.

What is claimed is:

1. A system to drill into a geological formation, the system comprising:

a mechanical drill bit including:

one or more devices to displace material from the geological formation; and an orifice;

an assembly including:

a projectile chamber;

a combustion chamber; and a launch tube extending from the combustion chamber to the orifice in the mechanical drill bit, wherein the launch tube is movable relative to a longitudinal axis of the mechanical drill bit to change an angle between an end of the launch tube and the longitudinal axis.

2. The system of claim 1, further comprising:

a plunger to position an endcap at the end of the launch tube, wherein retraction of the plunger from the launch tube evacuates a portion of the launch tube upstream of the endcap.

3. The system of claim 1, wherein the projectile chamber is configured to hold one or more projectiles and one or more endcaps and responsive to a pressure differential between the projectile chamber and the combustion chamber, a projectile of the one or more projectiles and an endcap of the one or more endcaps pass from the projectile chamber into the launch tube.

4. The system of claim 1, further comprising a conduit in communication with the projectile chamber, wherein the conduit is configured to transport a projectile to the projectile chamber.

5. The system of claim 1, further comprising a conduit in communication with the combustion chamber, wherein the conduit is configured to transport propellant to the combustion chamber.

6. The system of claim 1, further comprising:

a bent sub, wherein the bent sub is positioned at a first end of the assembly and the mechanical drill bit is positioned at a second end of the assembly.

7. The system of claim 6, further comprising:

a turbine mud motor engaged with the bent sub via a drive shaft, wherein the turbine mud motor and the drive shaft include a throughbore that permits passage of one or more of:

a projectile; or a propellant.

8. The system of claim 1, wherein the launch tube is movable relative to the longitudinal axis of the mechanical drill bit between a first position in which an end of the launch tube is parallel to the longitudinal axis and a second position in which the end of the launch tube is non-parallel relative to the longitudinal axis.

9. The system of claim 8, further comprising:

a first set of teeth arranged on an exterior of the launch tube;

wherein the mechanical drill bit further includes:

an adjustment slot extending from a position that is proximate to a center of the mechanical drill bit to a position that is offset relative to the center, wherein the adjustment slot includes a second set of teeth configured to engage the first set of teeth.

10. A method comprising:

moving an endcap and a projectile through a launch tube using a plunger, wherein movement of the endcap through the launch tube displaces material from a first end of the launch tube;

positioning the endcap at the first end of the launch tube using the plunger, wherein the first end extends proximate to an orifice in a drill bit and the positioning of the endcap at the first end at least partially seals the first end of the launch tube;

withdrawing the plunger from the first end of the launch tube, wherein movement of the plunger from the first end of the launch tube evacuates at least a portion of the launch tube;

positioning the projectile at a second end of the launch tube using the plunger;

propelling the projectile through the endcap such that the projectile exits the launch tube and impacts a portion of a geological formation; and moving the drill bit towards the portion of the geological formation.

11. The method of claim 10, further comprising:

directing a path of the drill bit through the geological formation by launching projectiles toward a first side of a hole.

12. The method of claim 10, further comprising:

transporting the projectile to a projectile chamber using a conduit; and moving the projectile from the projectile chamber to the launch tube.

13. The method of claim 10, further comprising:

positioning the first end of the launch tube at a non-parallel angle relative to a longitudinal axis of the drill bit;

determining that the first end of the launch tube is positioned toward a first side of the drill bit relative to the longitudinal axis; and igniting a propellant responsive to the determining that the first end of the launch tube is positioned toward the first side.

14. The method of claim 10, further comprising:

moving, responsive to a pressure differential, the projectile from a projectile chamber to a combustion chamber that is in communication with the launch tube;

filling the combustion chamber with a propellant; and igniting the propellant within the combustion chamber.

15. The method of claim 10, further comprising:

moving the first end of the launch tube relative to a longitudinal axis of the drill bit to change an angle between the first end of the launch tube and the longitudinal axis.

16. A system comprising:

a drill bit including:

one or more devices to displace material; and an orifice extending through the drill bit;

an assembly including:

a combustion chamber; and a launch tube extending from the combustion chamber to the orifice in the drill bit, wherein the launch tube is movable relative to a longitudinal axis of the drill bit to change an angle between an end of the launch tube and the longitudinal axis.

17. The system of claim 16, further comprising:

a plunger to:

position an endcap in the launch tube proximate to the orifice; and evacuate a portion of the launch tube upstream of the endcap.

18. The system of claim 16, wherein the launch tube is movable relative to the longitudinal axis of the drill bit between a first position in which the end of the launch tube is parallel to the longitudinal axis and a second position in which the end of the launch tube is non-parallel relative to the longitudinal axis.

19. The system of claim 16, further comprising:

a projectile chamber;

a plunger; and a closure mechanism separating the projectile chamber from the launch tube, wherein the plunger is configured to move a projectile from a first position in the projectile chamber on a first side of the closure mechanism to a second position within the launch tube on a second side of the closure mechanism.

20. The system of claim 16, further comprising:

an endcap within the launch tube between the orifice and a projectile, wherein the endcap is configured to be penetrated by the projectile.

* * * * *